US011674311B1

(12) United States Patent
Forrest

(10) Patent No.: US 11,674,311 B1
(45) Date of Patent: Jun. 13, 2023

(54) COVER SYSTEM AND METHOD FOR RETRACTABLE BUILDINGS

(71) Applicant: HIBER TECHNOLOGIES LLC, Newport Beach, CA (US)

(72) Inventor: Gregory Holden Forrest, Newport Beach, CA (US)

(73) Assignee: HIBER TECHNOLOGIES LLC, Newport Beach, CA (US)

( * ) Notice: Subject to any disclaimer, the term of this patent is extended or adjusted under 35 U.S.C. 154(b) by 0 days.

(21) Appl. No.: 17/982,771

(22) Filed: Nov. 8, 2022

(51) Int. Cl.
*E04B 7/16* (2006.01)

(52) U.S. Cl.
CPC ..... *E04B 7/166* (2013.01)

(58) Field of Classification Search
CPC ..... E04B 1/343; E04B 7/16; E04B 7/166
See application file for complete search history.

(56) References Cited

U.S. PATENT DOCUMENTS 4,204,372 A * 5/1980 Agopyan ..... E04B 1/3448 52/64
2020/0181900 A1* 6/2020 Fedor ..... E04B 1/343
2021/0189741 A1* 6/2021 Forrest ..... E04H 9/14
2022/0243466 A1* 8/2022 Vervisch ..... E04B 7/166
2022/0403651 A1* 12/2022 Anshin ..... E04B 7/166

FOREIGN PATENT DOCUMENTS

DE 10351941 A1 * 6/2005 ..... E04B 7/166
FR 2633651 A1 * 6/1988
WO WO-2021116992 A1 * 6/2021 ..... E04B 7/166

OTHER PUBLICATIONS

Machine translation for DE10351941 Jun. 2005. Printed Jan. 6, 2023.*

* cited by examiner

*Primary Examiner* — Christine T Cajilig
(74) *Attorney, Agent, or Firm* — Cohen IP Law Group, PC; Michael N. Cohen

(57) ABSTRACT

An extendable cover system and method for extending a cover over an opening is provided. The system includes a plurality of panels oriented horizontally and stacked vertically at a side of the opening, with each panel held by a corresponding panel holding arm. One or more guide rails extend across the opening to receive the panels. A panel moving mechanism moves the panels one-by-one onto the one or more guide rails. Each time a panel is deployed, the panel holding arms are lifted vertically to align a next panel with the guide rails, the next panel is then deployed, and the process continues until the opening is covered.

20 Claims, 27 Drawing Sheets

COVER SYSTEM AND METHOD FOR RETRACTABLE BUILDINGS

FIELD OF THE INVENTION

This invention relates to covers, including an extendable cover system for retractable buildings.

BACKGROUND

The catastrophic destruction caused by wildfires, tornados, and hurricanes to residential homes and other types of building structures has become a worldwide crisis. In just the last decade, wildfires in California alone have resulted in over 170,000 homes destroyed, 1,000 dead, and over $120 billion in cash losses.

To combat these crisis in real time, a novel solution has been developed that involves lowering an at-risk building into an underground compartment thereby removing the building from the dangers above. For example, a building structure translation system has been developed to lower at-risk buildings underground as disclosed in U.S. Pat. No. 11,274,456, filed Sep. 3, 2020, the entire contents of which are hereby fully incorporated herein by reference for all purposes.

Once the buildings have been moved underground, a protective cover must be deployed to cover the underground compartment and the building inside for protection from the threat (e.g., from a wildfire raging above).

Accordingly, there is a need for a system and method that deploys a protective cover over buildings that have been translated underground.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF EXEMPLARY EMBODIMENTS

As used herein, unless used otherwise, the following terms and abbreviations have the following meanings.

The term "building" will refer to any type of physical building structure including (without limitation), residential buildings, commercial buildings, homes, condominiums, apartment buildings, single-unit buildings, multi-unit buildings, educational buildings, institutional buildings, assembly buildings, business buildings, mercantile buildings, industrial buildings, storage buildings, wholesale establishments, mixed land use buildings, hazardous buildings, detached buildings, semi-detached buildings, multi-story or high-rise buildings, slums, unsafe buildings, special buildings, single-level car parking, multi-level car parking, other types of buildings and any combination thereof. Building structures also may include structures such as antennas, towers, bridges, overpasses, industrial pipes, telephone lines/poles, power lines/poles, communication lines/poles, utility lines/poles, traffic signals, other types of structures and any combination thereof. It is understood that a building structure may include a single building structure or multiple building structures.

Figure 1:
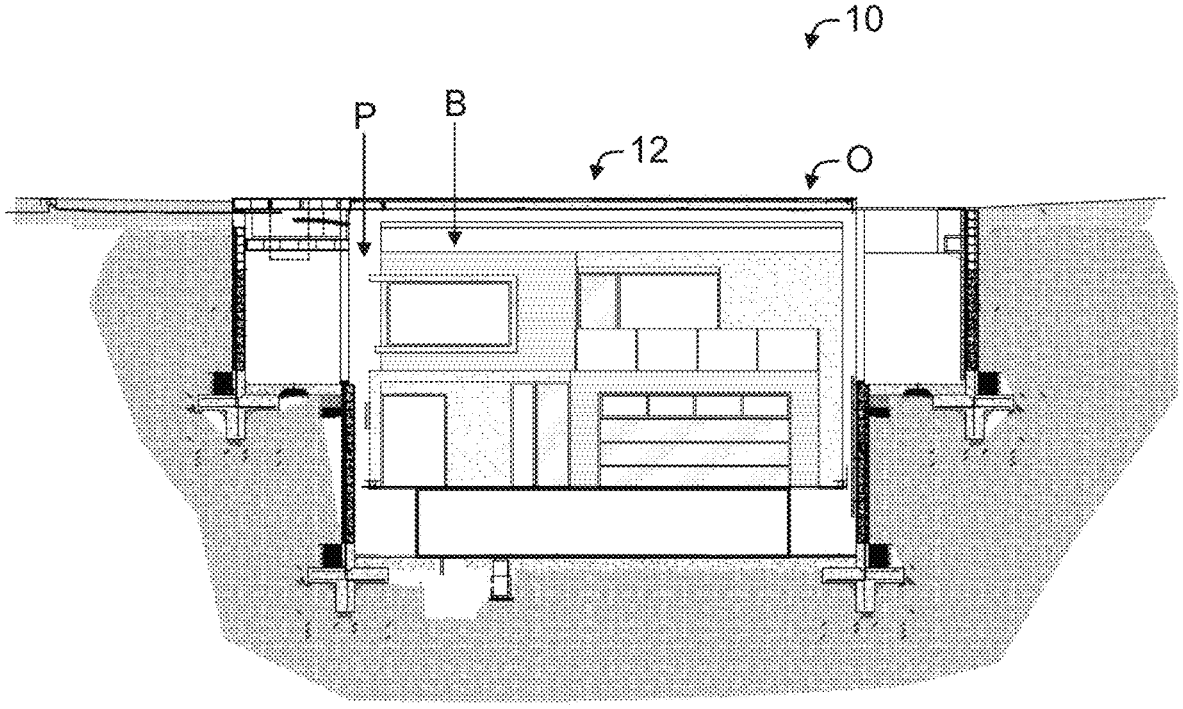
FIG. 1 shows aspects of an extendable cover system according to exemplary embodiments hereof.

In general, as shown in FIG. 1, the extendable cover system 10 of the current invention according to exemplary embodiments hereof is designed to provide an extendable cover 12 across an open area, e.g., across an open area O above a building B that has been lowered into an underground pit P for protection during a wildfire.

For the purposes of this specification, the system 10 may be described primarily in relation to its use with residential homes, however, it is understood that the system 10 may be applied to any types of buildings and the scope of the system 10 is not limited in any way by the types of buildings that it may be applied to.

Figure 2:
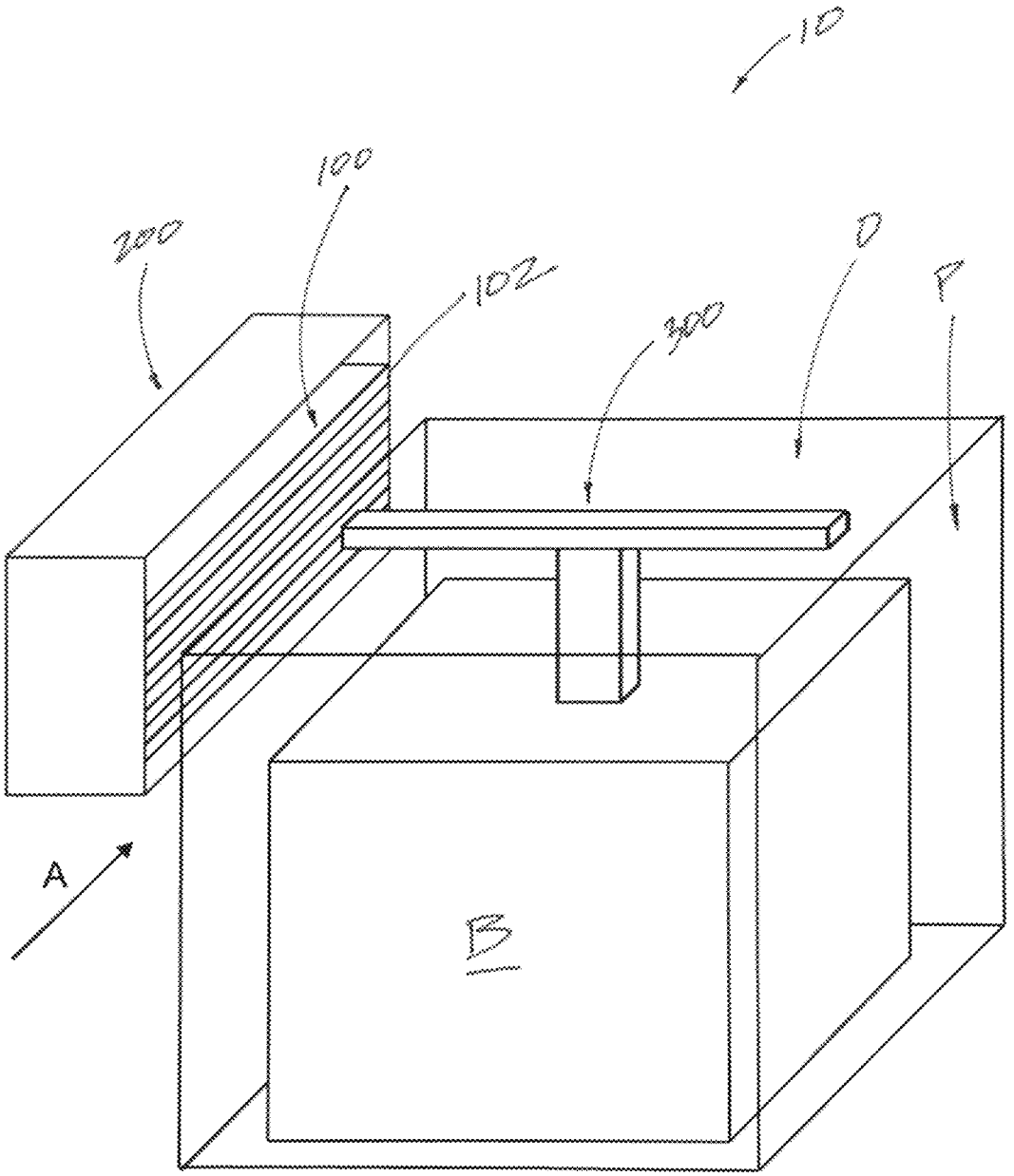
FIG. 2 shows aspects of an extendable cover system according to exemplary embodiments hereof.

In some embodiments as shown in FIG. 2, the extendable cover system 10 (also referred to herein as the cover system 10 or simply as the system 10) includes a panel assembly 100, a panel delivery system 200, and a panel guide system 300. The panel assembly 100 includes one or more panels 102 that, when configured together, form the fire-proof cover 12. The panel delivery system 200 delivers the panels 102 to the panel guide system 300 for distribution and configuration across the open area O. The system 10 also may include other systems, assemblies, and/or elements necessary for the system 10 to perform its functionalities.

For the purposes of this specification, the cover system 10 will be described primarily with respect to being implemented to cover a building that has been lowered into an underground pit for protection during a wildfire. For example, the cover system 10 may be implemented with a building structure translation system as disclosed in U.S. Pat. No. 11,274,456, filed Sep. 3, 2020, the entire contents of which are hereby fully incorporated herein by reference for all purposes. However, it is understood that the system 10 may be used to cover any type of opening and that the system 10 is not limited in any way by the type of opening that the system 10 is implemented with.

FIG. 2 shows a generalized schematic of the system 10 including the panel assembly 100, the panel delivery system 200, and the panel guide system 300, and FIGS. 3-10 show the panel assembly 100, the panel delivery system 200, and the panel guide system 300 taken from the perspective of the arrow A in FIG. 2. The outlines of the pit P have been omitted in FIGS. 3-10 for clarity. In addition, the panel assembly 100, the panel delivery system 200, and the panel guide system 300 are represented in these drawings as generalized blocks for clarity. However, it is understood that this is for demonstration and that the elements 100, 200, 300 may be formed as any shapes and/or forms as necessary to perform their respective functionalities as described herein. This will be described in other sections.

Figure 3:
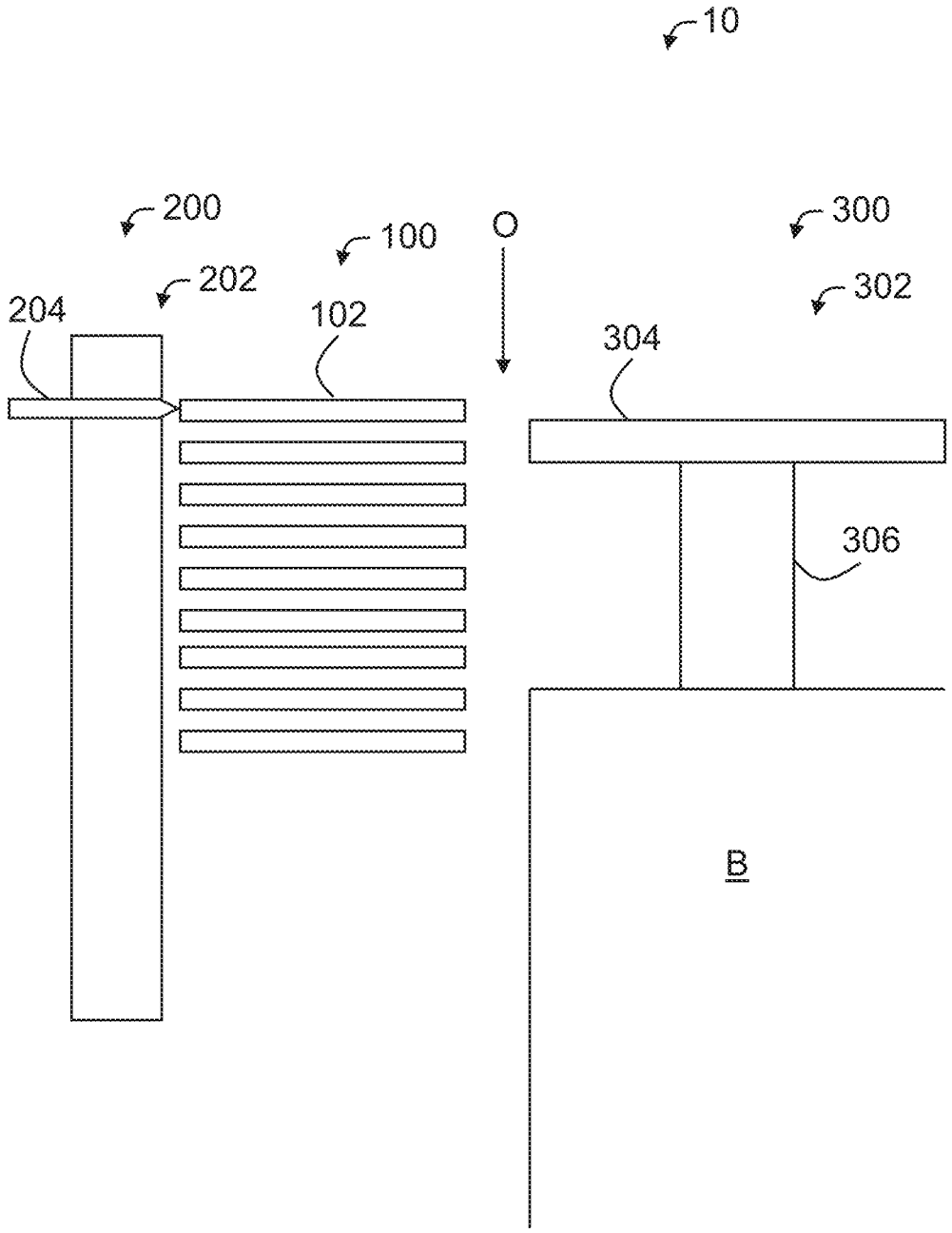
FIGS. 3-10 show aspects of an extendable cover system according to exemplary embodiments hereof.

In some embodiments, as shown in FIG. 3, the panel assembly 100 includes one or more panels 102 and the panel delivery system 200 includes a panel holding unit 202. In some embodiments, the panels 102 are generally stacked individually and held by the panel holding unit 202. While the panels 102 are shown to be stacked vertically, it is understood that the panels 102 may be arranged in other formations. As will be described in other sections, each individual panel 102 may be held in position by one or more positioning arms configured with the panel holding unit 202 (omitted from this view for clarity).

In some embodiments, as shown in FIG. 3, the panel guide system 300 includes one or more guide units 302 comprising one or more guide rails 304 supported by one or more guide base structures 306. In some embodiments, the guide units 302 are configured with an upper portion of the building B, e.g., with the building's roof. It also is understood that the guide units 302 may be configured with other structures associated with the building B, with the pit P, and/or any other structures that may be suitable. For example, a guide unit 302 may be configured on top of a column extending upward from a patio adjacent the building B, and/or from a surface of the foundation associated with the building, and/or from a structure associated with the building structure translation system that may be used to lower the building B into the pit P. It is understood that the guide units 102 may be configured with any suitable structure that may lend the required support to the guide units 102 so that the guide units 102 may perform their functionalities during use.

As will be described herein, the panel delivery system 200 includes a panel pusher 204 designed to deliver the panels 102, one by one, to the panel guide system 300 for distribution and configuration across the open area O above the building B.

Figure 4:
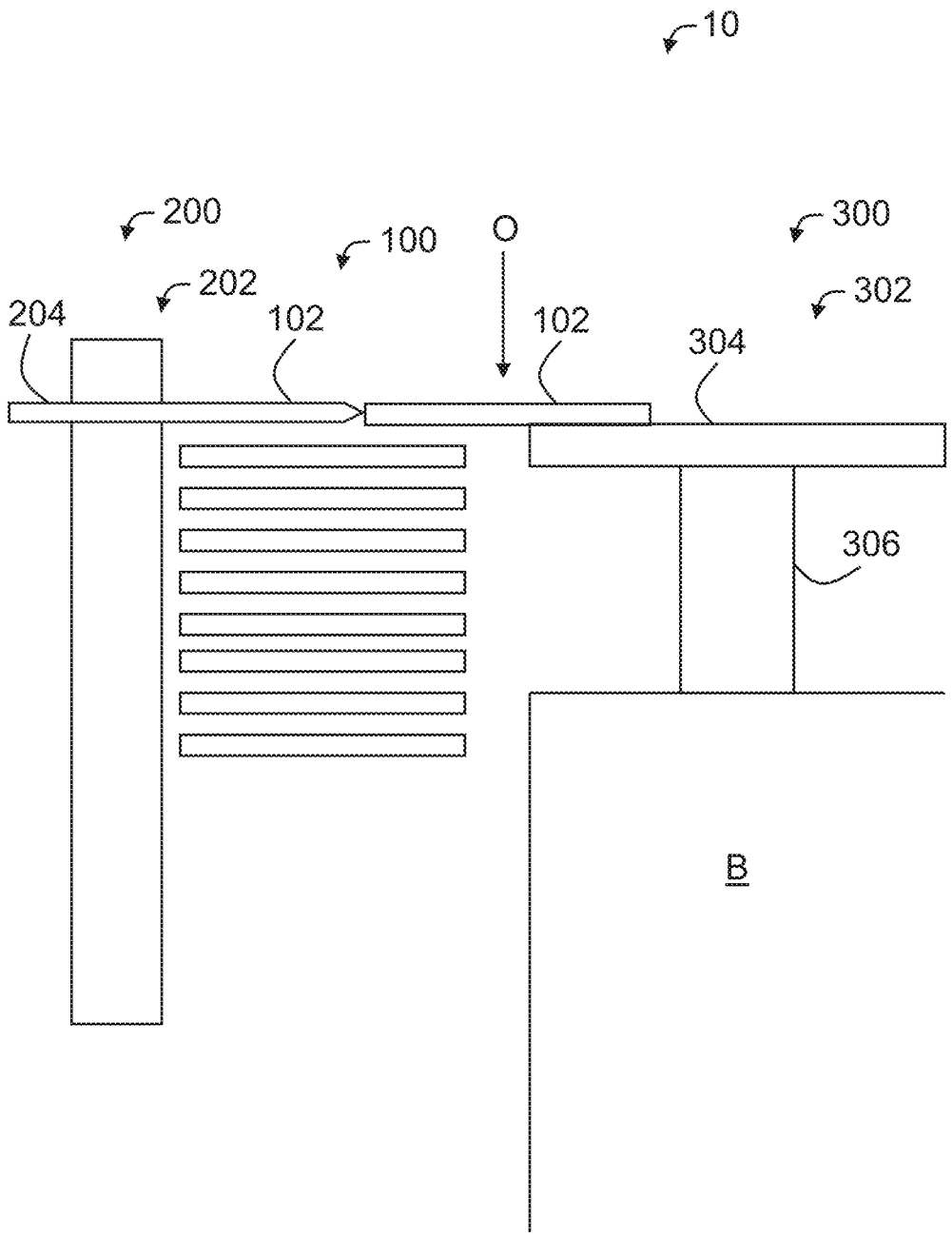
Figure 5:
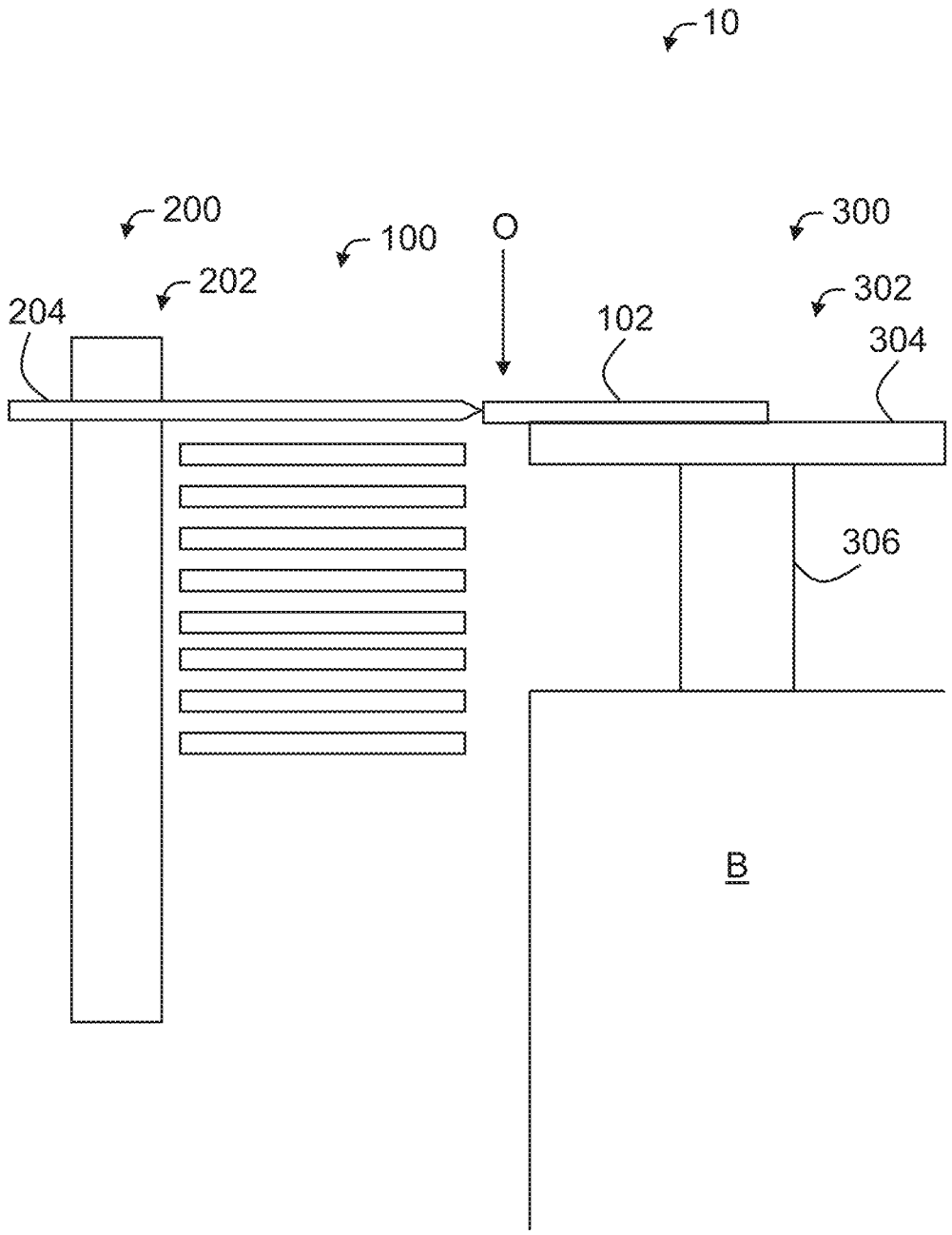

In some embodiments, as shown in FIG. 3, the panel holding unit 202 aligns a first panel 102 (e.g., the panel 102 at the top of the stack) with a guide rail 304 for deployment. Once the panel 102 is aligned, the panel pusher 204 pushes the panel (e.g., horizontally) onto the rail 304. This is shown in FIG. 4. Once the panel 102 is pushed onto the rail 304 and the panel 102 clears the panel holding unit 202 (see FIG. 5), the panel pusher 204 may retract and await another panel 102 (see FIG. 6).

Figure 6:
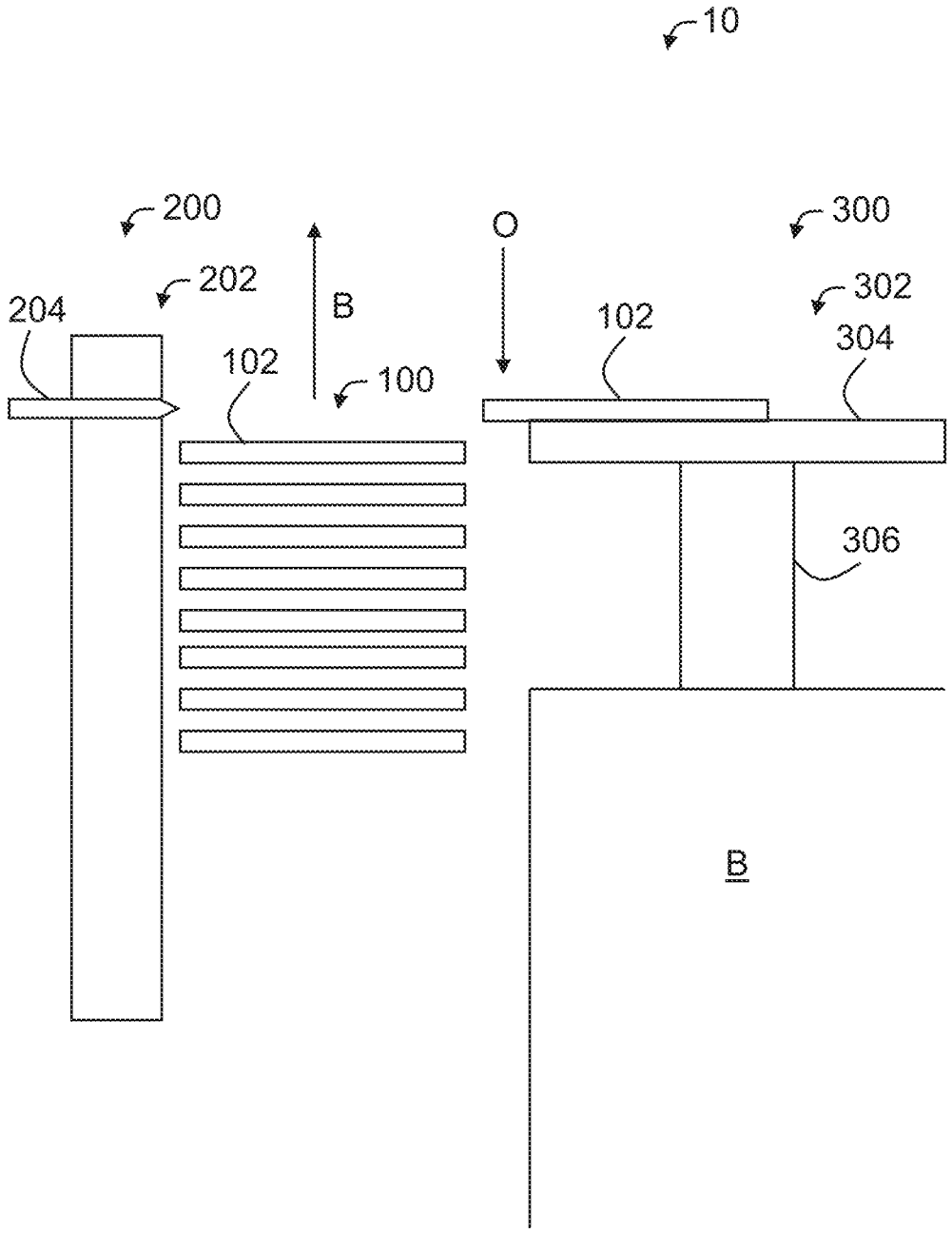
Figure 7:
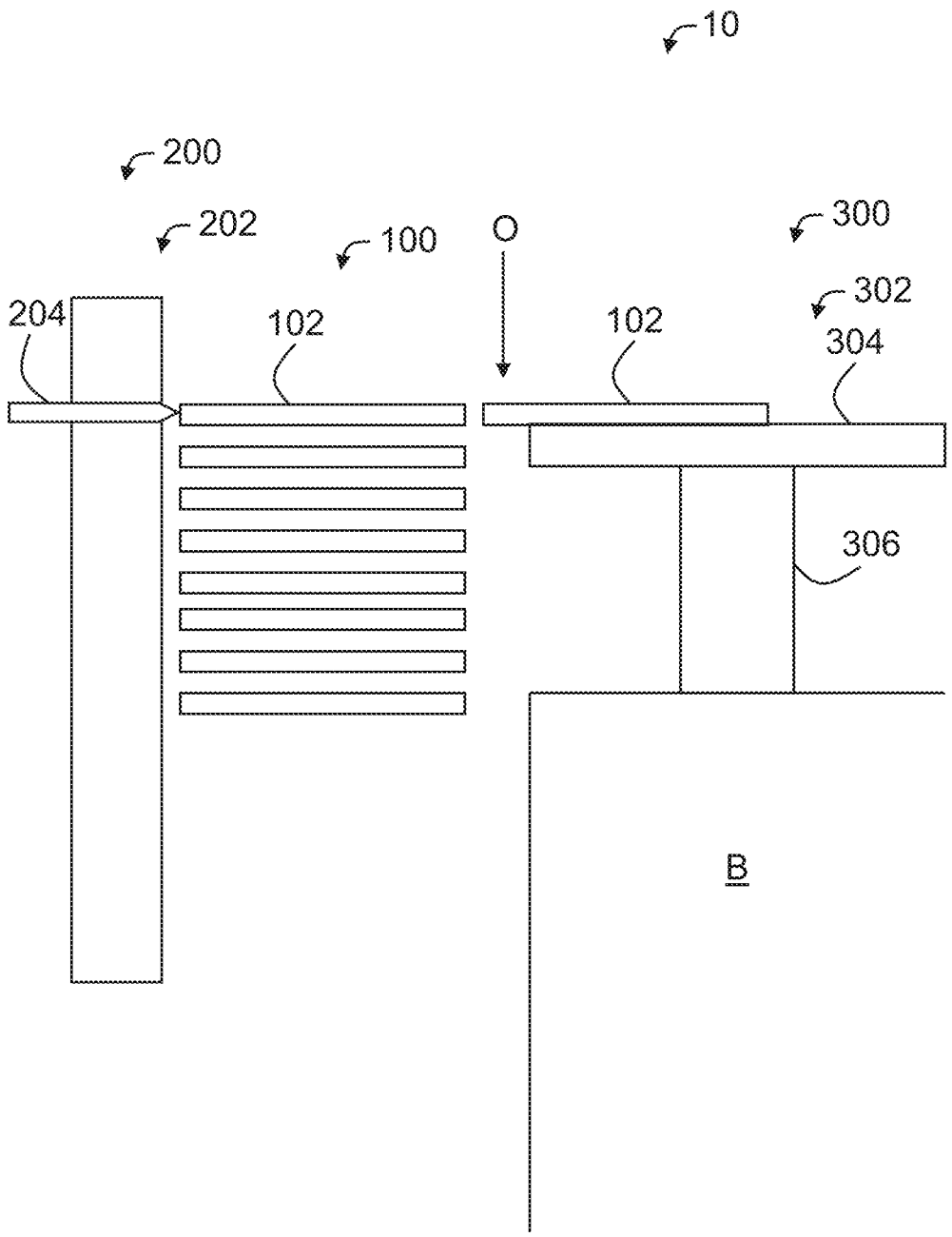
Figure 8:
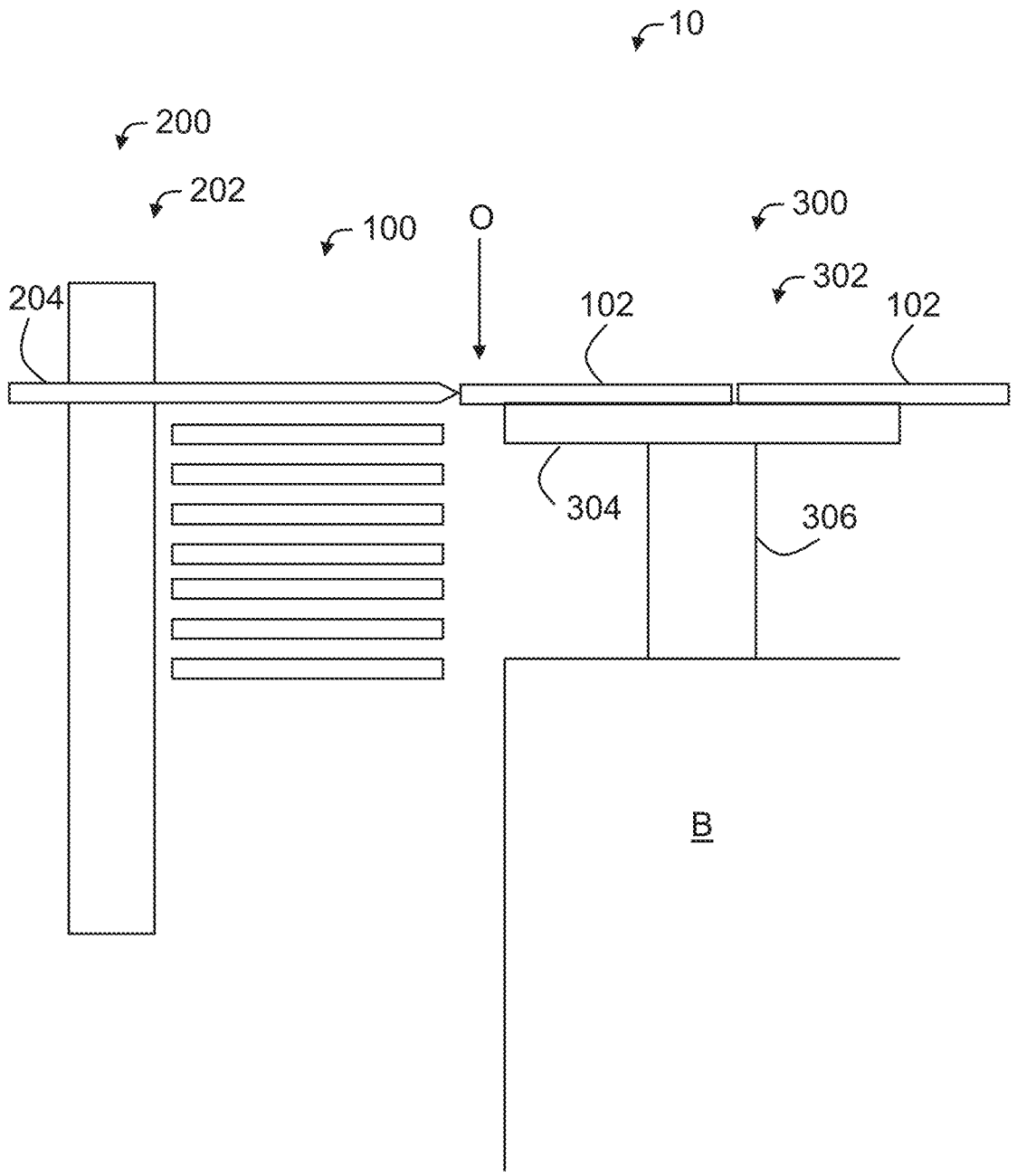
Figure 9:
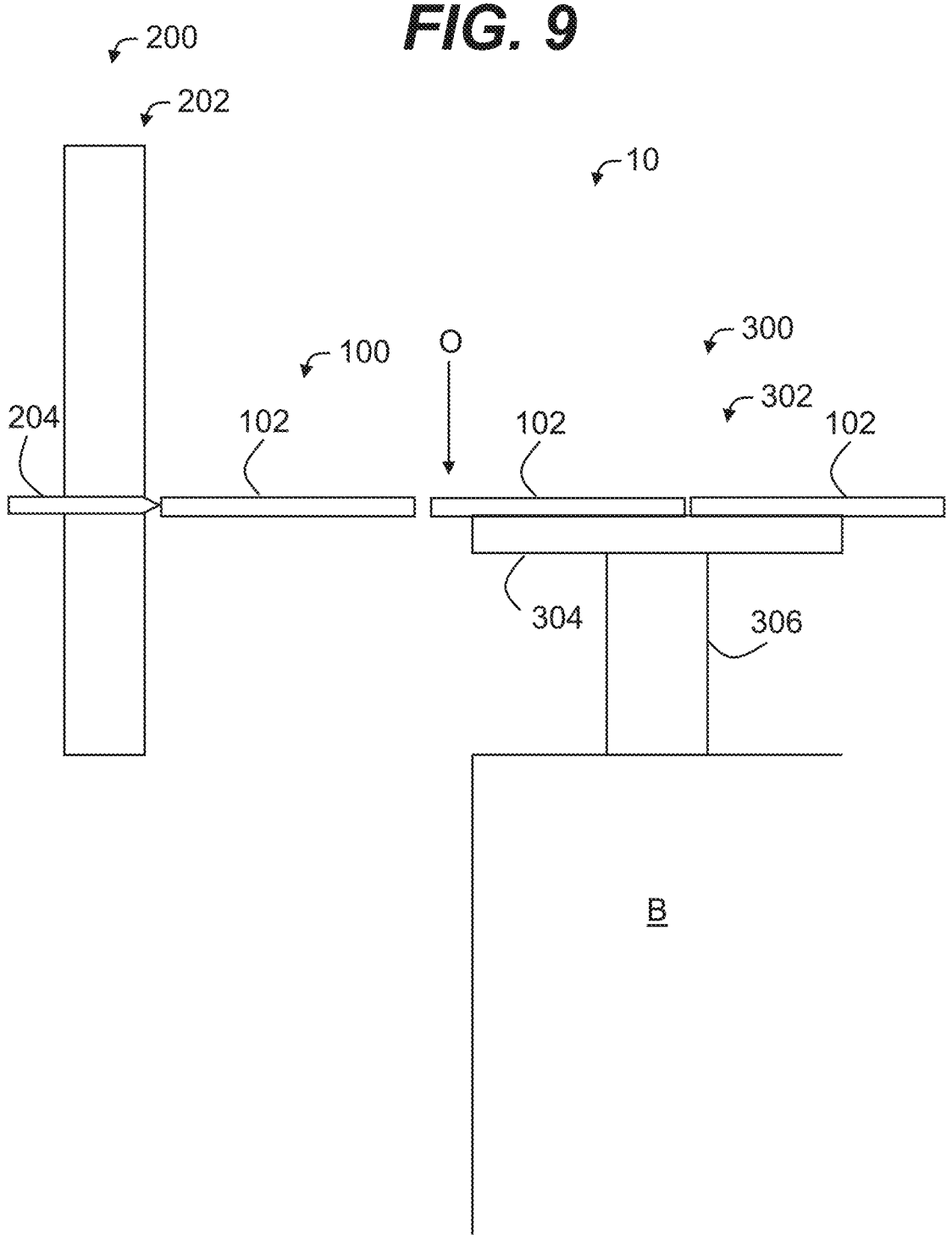

In some embodiments, as shown in FIG. 6, the panel holding unit 302 may next raise the remaining stack of panels 102 upward in the direction of the arrow B (e.g., about 6") and align the next panel 102 (the new top panel 102 at the top of the stack) with the guide rail 304. This is shown in FIG. 7. The panel pusher 204 may then push the panel 102 onto the rail 304 behind the first deployed panel 102. This is shown in FIG. 8. Notably, deployment of the second panel 102 pushes the first panel 102 further along the guide rail 304 over the opening O. Once the second panel 102 is deployed, the panel pusher 204 may retract and the sequence continues until the last panel 102 is raised to the top (see FIG. 9). Then, as shown in FIG. 10, the panel pusher 204 may push the last panel 102 onto the guide rail 304 thereby pushing the panels 102 deployed prior further across the opening O.

Figure 10:
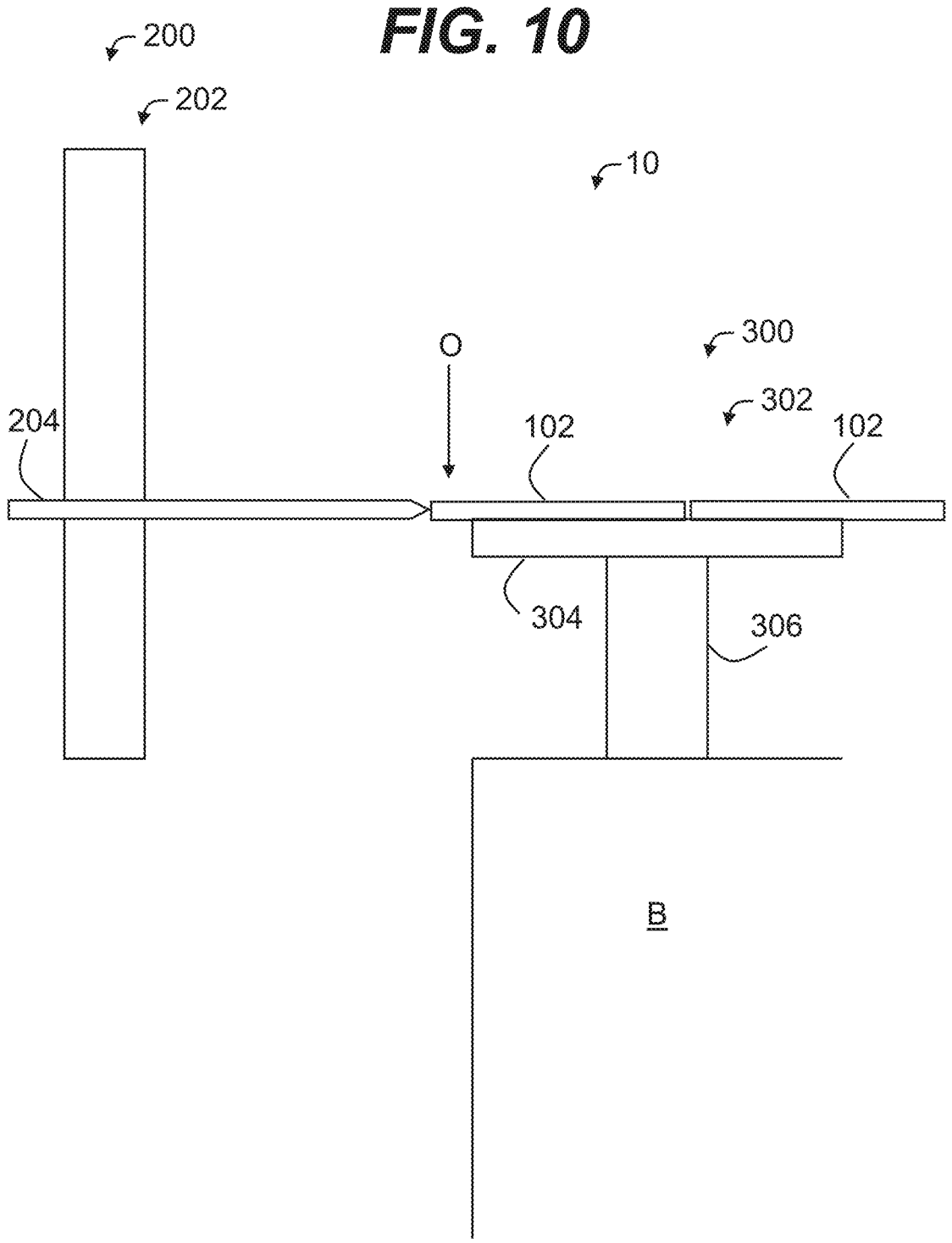

In some embodiments, as shown in FIG. 10, with the last panel 102 delivered to the guide rail 304, the first panel 102 deployed (see FIG. 4) may reach and generally abut against the opposite side of the opening O, with the intermediate panels 102 all aligned sequentially behind it and pressed together tight to form the cover 12. In some embodiments, the panels 102 are dimensioned such that a predetermined number of panels 102 may span across and fully cover the opening O. In some embodiments, one or more of the panels 102 (e.g., the final panel 102) may be dimensioned differently than the others to cause this result. In some embodiments, with the last panel 102 deployed, the panel pusher 204 may remain extended pressing laterally against the last panel 102 to provide a lateral force to the sequence of panels 102 to ensure that the interface between each sequential panel 102 is tight and properly sealed. This is shown in FIG. 10.

Figure 11:
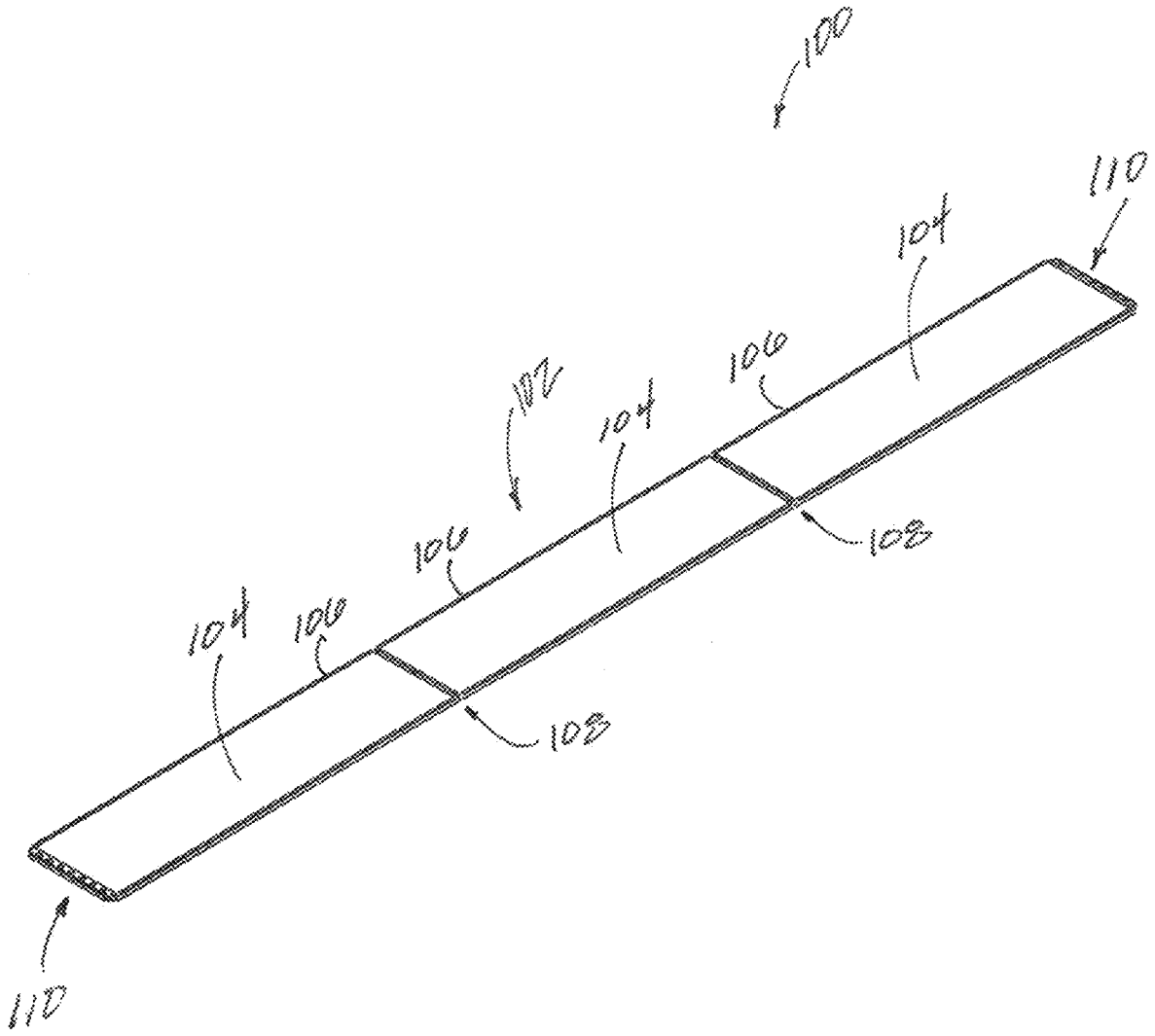
FIGS. 11-12 show aspects of a panel according to exemplary embodiments hereof.

In some embodiments, as shown in FIG. 11, the panel assembly 100 includes one or more panels 102. In general, the panels 102 are rectangular but it is understood that the panels 102 may include other shapes or forms as required. In some embodiments, the panels 102 may include one or more panel sections 104 that when combined together (e.g., end-to-end as shown) form a complete panel 102. While three panel sections 104 per panel 102 are shown it is understood that any number of panel sections 104 may be used to form a panel 102.

In some embodiments, each panel section 104 includes a frame 106 that extends about at least a portion of the respective panel's outer edges. The frame 106 may be attached to the panel section 104 using screws, bolts, welding, and/or any other types of attachment mechanisms. Once attached, the frame 106 may provide additional rigidity to its respective panel section 106 as well as provide an area that other elements may be attached to (e.g., the coupler 108 and/or end caps 110 as described below).

Figure 12:
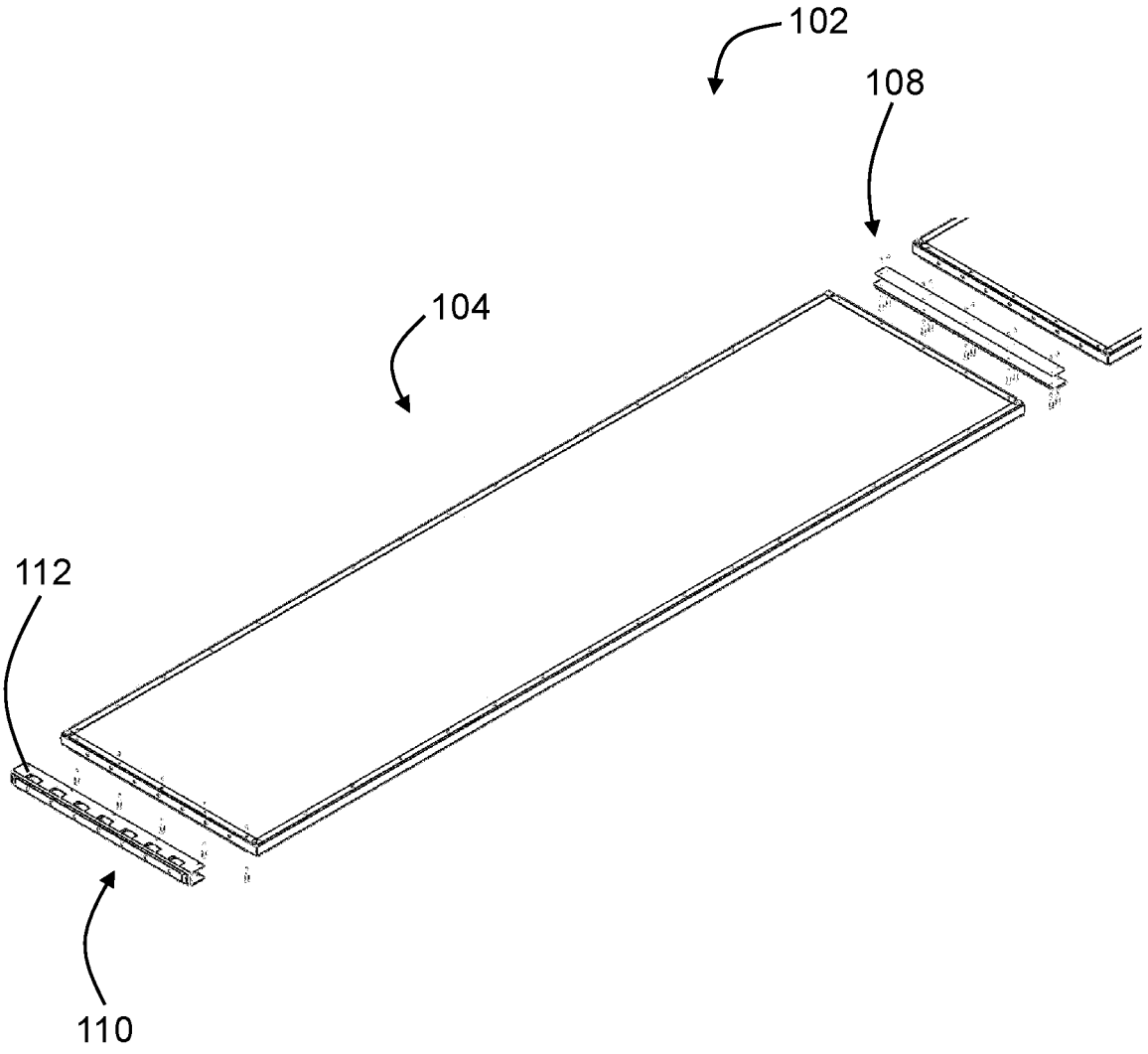

In some embodiments, as shown in FIG. 12, the panel sections 104 are connected to one another using a panel coupler 108. As shown, the coupler 108 may include a bracket or similar structure with connecting elements on either side that may each receive and secure one end of a respective panel section 104 (e.g., an end portion of the panel's frame 106). Accordingly, when configured between two panel sections 104, the coupler 108 is generally sandwiched between the ends of the respective sections 104 as shown. The coupler 108 in FIG. 12 is shown disconnected from the panel sections 104 for clarity. The sections 104 may be attached to the coupler 108 using screws, bolts, welding, adhesive, clamps, other attachments mechanisms, and any combinations thereof. As will be described in other sections, the couplers 108 also may be utilized as roller plates that may engage rollers configured with the panel guide system 300.

In some embodiments, the panels 102 include end caps 110 on either end. The end caps 110 may include rollers 112 that extend at least partially above the upper surface of the respective end cap 110 and/or below the lower surface of the respective end cap 110. In this way, the rollers 112 may engage a surface on which the panel 102 may roll. As will be described in other sections, the rollers 112 may engage surfaces on the panel delivery system 200, surfaces in the foundation of the pit P, and/or other surfaces.

In some embodiments, each panel 102 comprises a suitable material that can withstand the temperatures expected during a wildfire. For example, in some embodiments, the panels 102 may comprise fire rated composite laminated materials, e.g., fiberglass laminated. It may be preferable that the panels 102 comprise materials that are FST M1 spec burn certified. Other certifications also may be preferable. In any event, it is understood that the panels 102 may comprise any suitable burn resistant materials and that the scope of the system 10 is not limited in any way by the types of materials used to form the panels 102 and/or any other components of the system 10.

Figure 13:
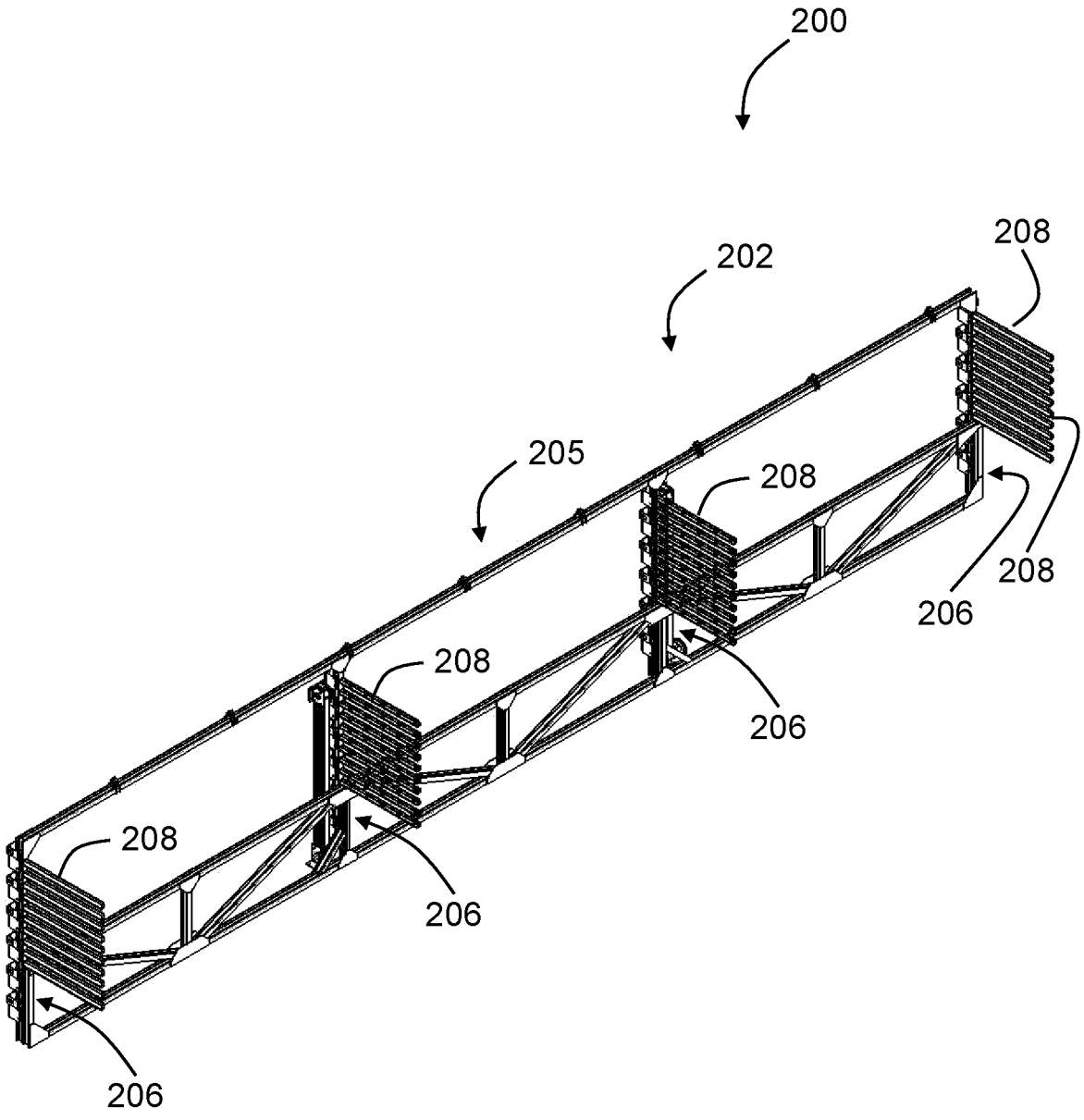
FIG. 13 shows aspects of a panel delivery system according to exemplary embodiments hereof.

In some embodiments, as shown in FIG. 13, the panel delivery system 200 includes a frame 202 including at least one generally lateral support element 205 and at least one generally upright support element 206. While FIG. 13 shows three lateral support elements 205 configured with four upright support elements 206, it is understood that any suitable numbers of lateral and/or upright support elements 205, 206 may be used. The elements 205, 206 may include beams, rails, bars, posts, other types of support elements, and any combinations thereof. It is understood that other support elements also may be used at other orientations with respect to the vertical and/or horizontal axis.

In some embodiments, as shown in FIG. 13, the panel delivery system 200 includes one or more bracket arms 208 designed to hold the panels 102 prior to the delivery of the panels 102 to the panel guide system 300. In some embodiments, the proximal end of each bracket arm 208 is coupled to at least one of the upright support elements 206, with the distal ends of the arms 208 extending outward therefrom (e.g., preferably orthogonally with respect to the upright supports 206). In this way, the panel delivery system 200 may be referred to as a rack.

In some embodiments, as shown in FIG. 13, the bracket arms 208 are aligned vertically and horizontally to form a matrix of bracket arms 208. For example, as shown in FIG. 13, the matrix of bracket arms 208 includes four columns and ten rows of bracket arms 208. In some embodiments, the bracket arms 208 in each column are aligned along a vertical axis, and the bracket arms 208 in each row are aligned along a horizontal axis. While the matrix of bracket arms 208 in FIG. 13 is shown in be four columns by ten rows, it is understood that the matrix of bracket arms 208 may include any number of rows and/or columns of arms 208.

Figure 14:
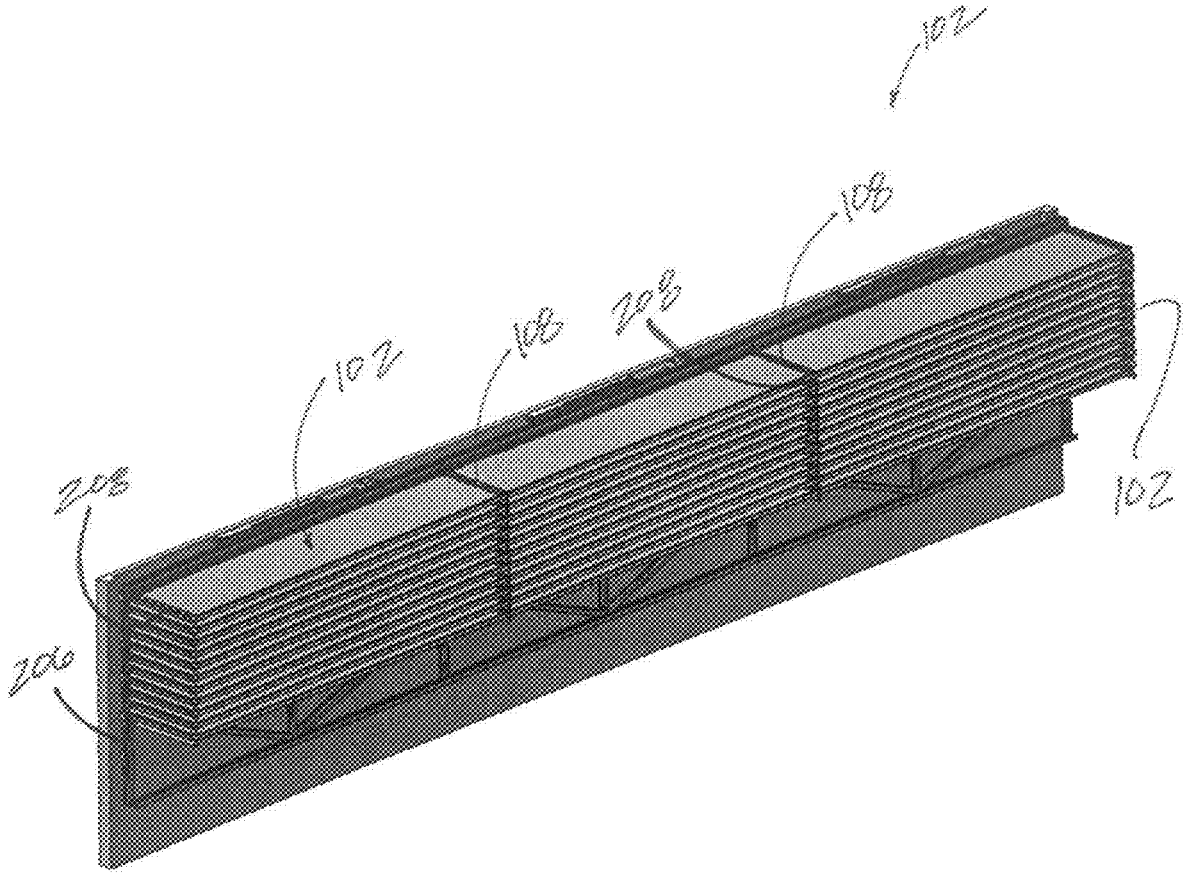
FIG. 14 shows aspects of a panel delivery system with panels according to exemplary embodiments hereof.

In some embodiments, as shown in FIG. 14, each row of bracket arms 208 is designed to hold one panel 102. In this way, when each bracket arm 208 is configured with a respective panel 102, the panels 102 are held in a stacked formation (with each panel 102 separated from the panel 102 above and/or below by a bracket arm 208).

Figure 15:
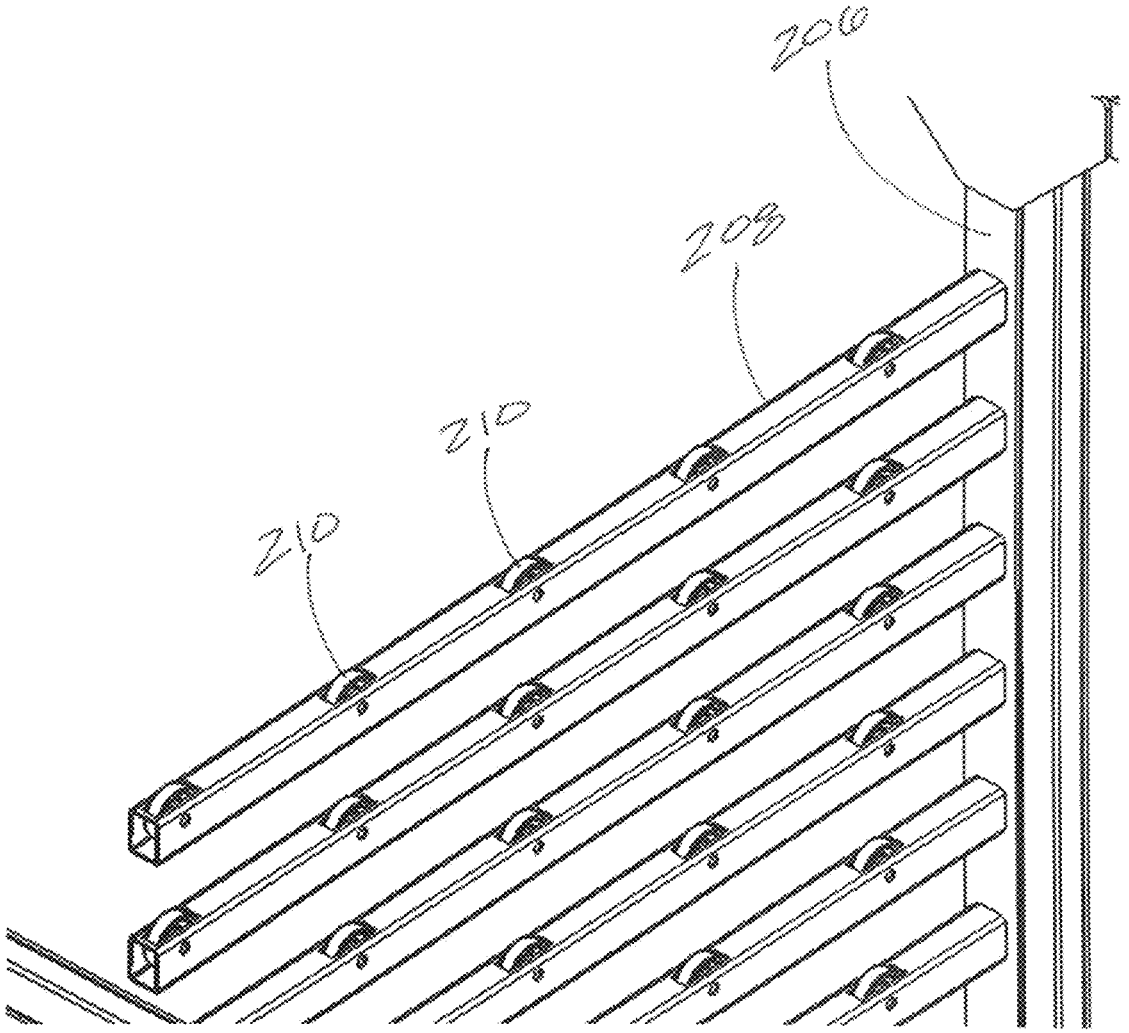
FIG. 15 shows aspects of a panel delivery system according to exemplary embodiments hereof.

In some embodiments, as shown in FIG. 15, at least some of the bracket arms 208 include integrated rollers 210, with the rollers 210 extending at least partially above the upper surface of a respective bracket arm 208. In this way, a panel 102 resting on the rollers 210 on the bracket arms 208 may be easily translated off of and subsequently back onto the bracket arms 208. For example, the panels 102 may be easily pushed off the bracket arms 208 and onto the panel guide system 300.

In some embodiments, the bracket arms 208 located in the inner two columns of bracket arms 208 (see FIG. 13) are equipped with rollers 210. In addition, the panel couplers 108 between the panel sections 104 of each panel 102 are aligned with the bracket arms 208 that include the rollers 210. That is, the couplers 108 are configured to rest upon the rollers 210 of the inner two columns of bracket arms 208 (see FIG. 14). In this way, the couplers 108 serve as rigid flat surfaces (e.g., roller plates) that may smoothly roll upon the rollers 210 during the movement of the panels 102 onto the panel guide system 300. In some embodiments, the bottom surfaces of the panel couplers 108 include a rolling surface (e.g., plastic) to provide a smooth surface. For example, the bottom surfaces of the couplers 108 may include strips of plastic, e.g., ultra-high molecular weight polyethylene (UHMW) and/or other suitable materials that engage the rollers 210.

Figure 16:
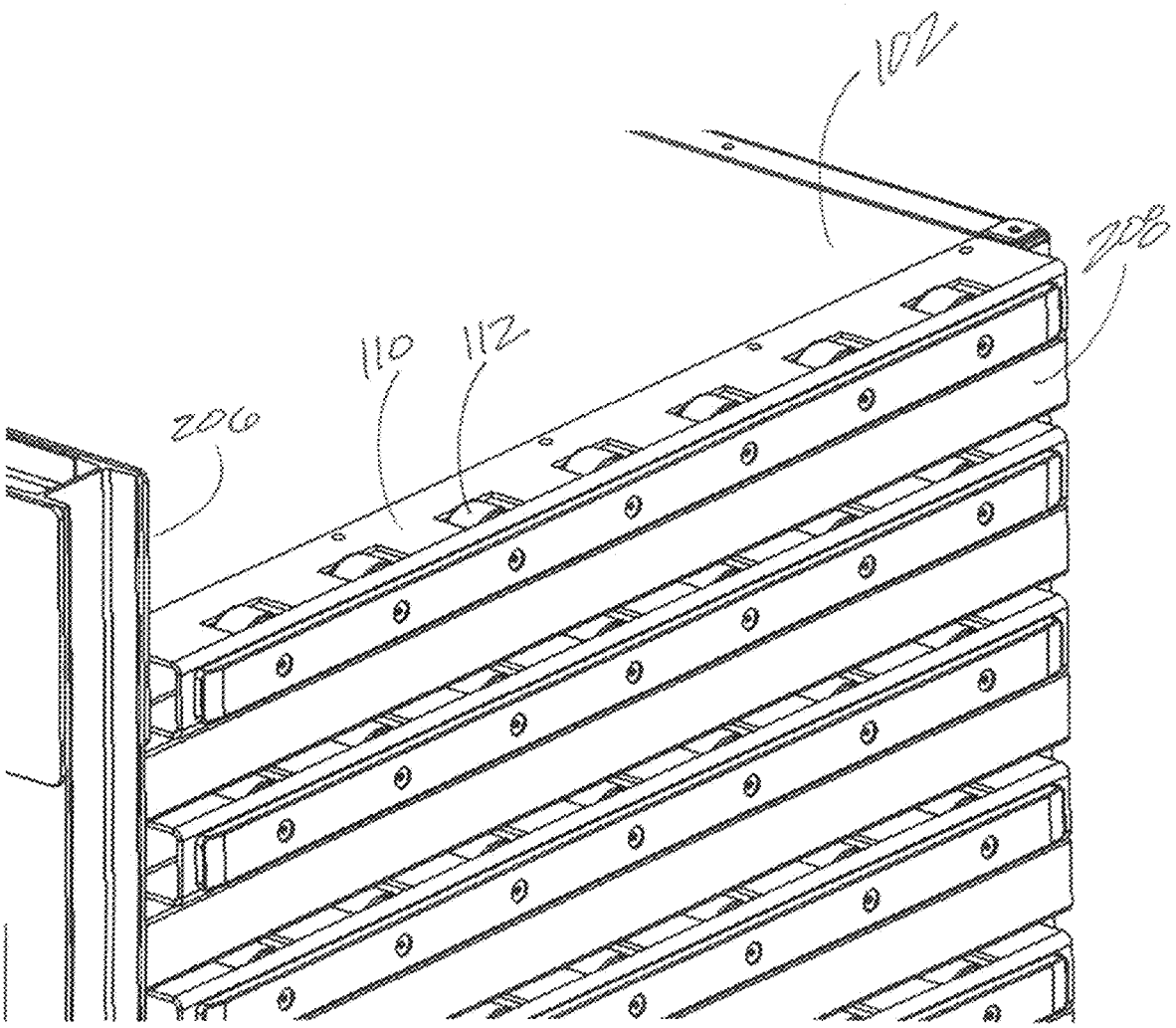
FIG. 16 shows aspects of a panel delivery system and a panel according to exemplary embodiments hereof.

In some embodiments, as shown in FIG. 16, some of the bracket arms 208 (e.g., the outer columns of bracket arms 208 of FIG. 13) may not include rollers 210, and instead, may include smooth upper surfaces. In this case, in some embodiments, the end cap rollers 112 configured at the ends of the panels 102 may be aligned to engage the smooth upper surfaces of the bracket arms 208. In this way, the end cap rollers 112 may roll upon the smooth bracket arms 208 during movement of the panels 102 onto the panel guide system 300. In other embodiments, as will be described in other sections, the panels' end cap rollers 112 are configured to roll within side channels within the pit P foundation.

Figure 17:
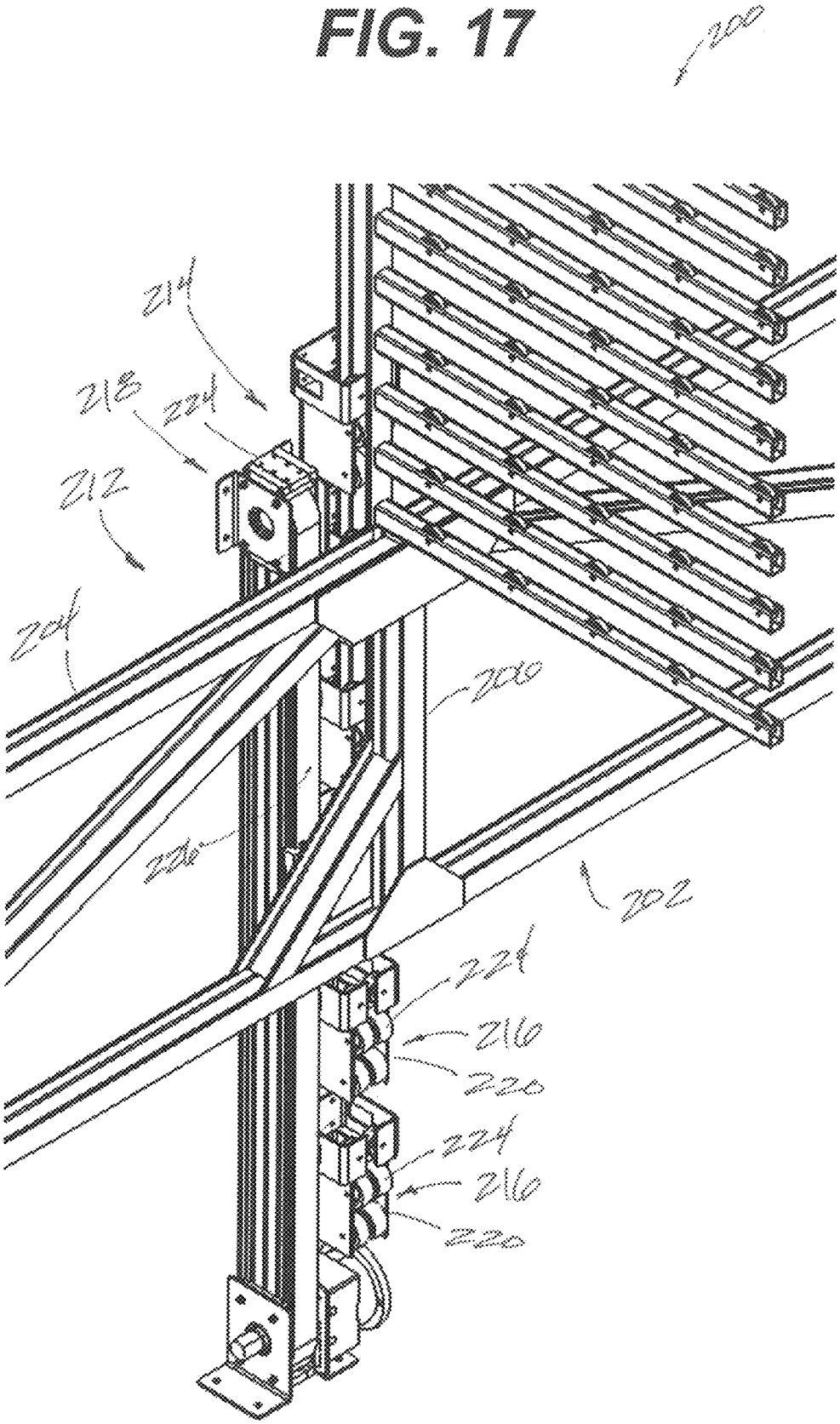
FIG. 17 shows aspects of a panel delivery system according to exemplary embodiments hereof.

In some embodiments, as shown in FIG. 17, the panel delivery system 200 includes a frame lifter assembly 212 designed to lift the delivery system's frame 202 during the deployment of the panels 102 as described in relation to FIGS. 3-10, and specifically, as shown in FIG. 6 (with the frame 202 being lifted upward in the direction of the arrow B).

Figure 18:
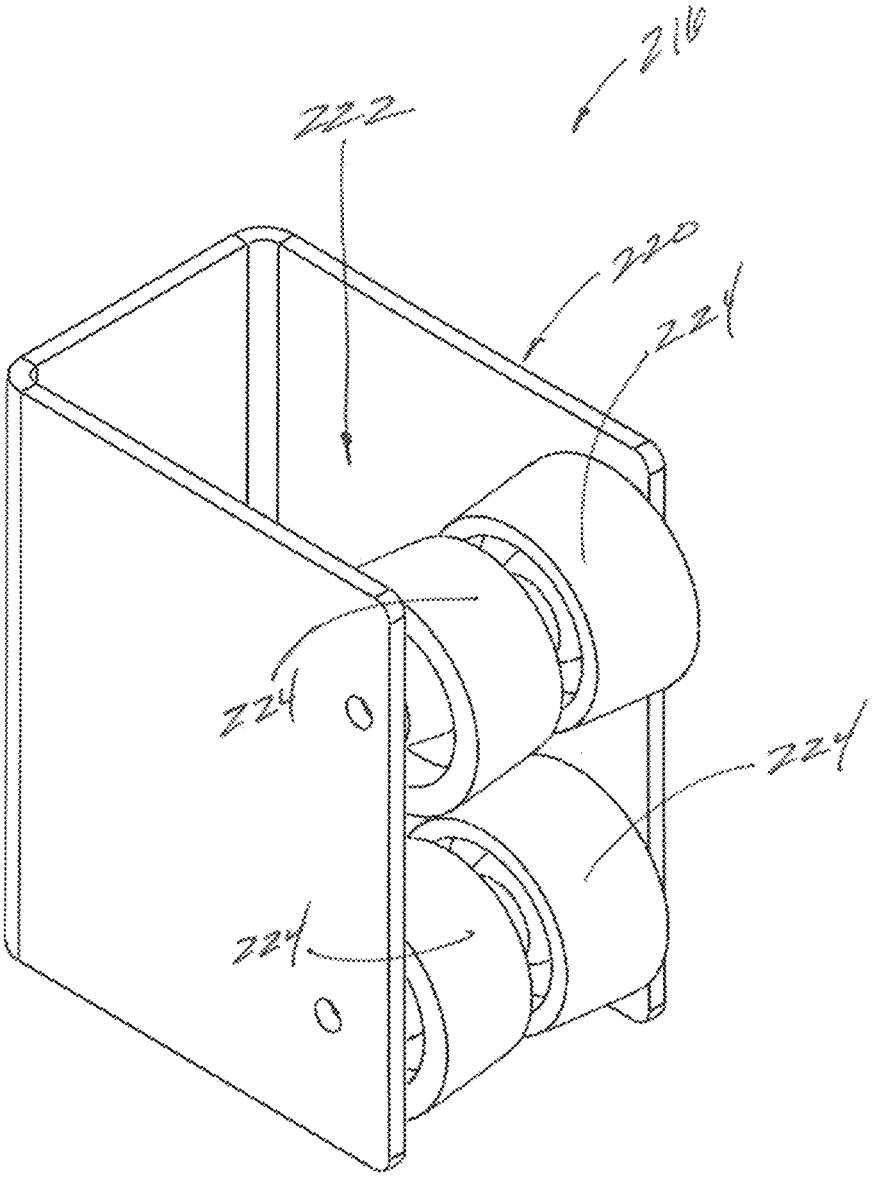
FIG. 18 shows aspects of a lifting guide according to exemplary embodiments hereof.

In some embodiments, as shown in FIG. 17, the frame lifter assembly 212 includes an upright lifting structure 214 equipped with lifting guides 216 and a lifting actuator 218. In some embodiments, as shown in FIG. 18, each lifting guide 216 includes a bracket member 220 defining an inner through path 222 and side rollers 224. The lifting guides 216 are aligned vertically, coupled to the upright lifting structure 214, and designed to receive a portion of an upright support element 206 to which the bracket arms 208 are coupled (see FIG. 17) through each guide's through path 222. As shown in FIG. 18, the side rollers 224 may include angled rolling surfaces to match the angles of the cross-sectional shape of the upright support element 206.

In some embodiments, the upright support element 206 and/or a lateral support element 205 is coupled to the lifting actuator 218, and the lifting actuator 218 is designed to lift and/or lower the upright support element 206, thereby lifting and lowering the delivery system's frame 202.

In some embodiments, as shown in FIG. 17, the lifting actuator 218 includes a belt drive 224 including a belt 226 to which the upright support element 206 is coupled. In this way, as the belt drive 224 moves the belt 226 (e.g., up and down along the loop) the upright support element 206 including the bracket arms 208 and panels 102 configured thereto also are moved. It is understood that any suitable lifting actuator 218 may be used, such as a scissors mechanism, a rack and pinion system, other suitable types of actuators, and any combinations thereof.

In some embodiments, the frame's inner two upright support elements 206 (see FIG. 13) are each configured with a frame lifter assembly 212 with the two frame lifter assemblies 212 operating in unison. However, it is understood that any number of frame lifter assemblies 212 may be used.

Figure 19:
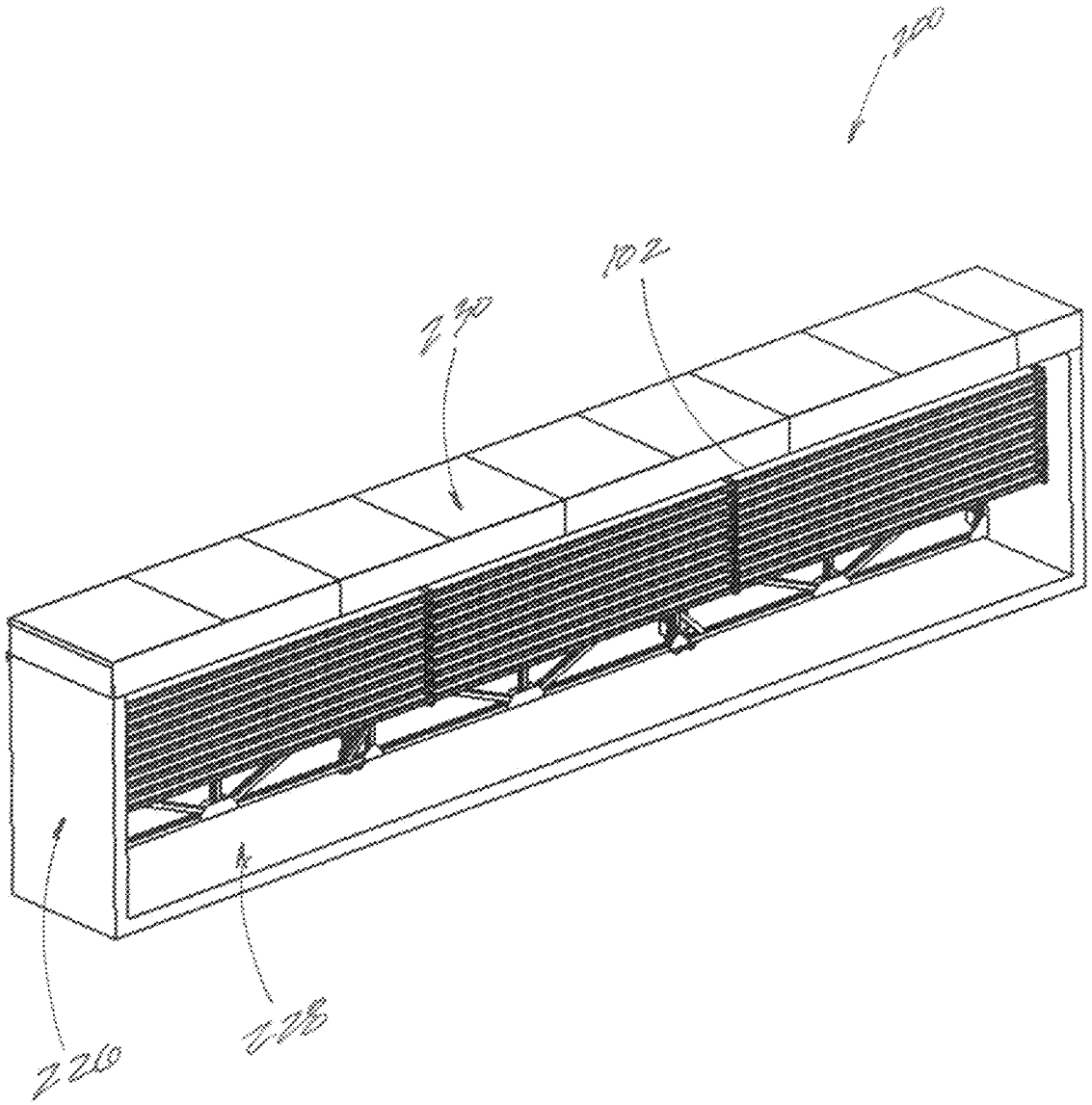
FIGS. 19-20 show aspects of a panel delivery system with panels according to exemplary embodiments hereof.
Figure 20:
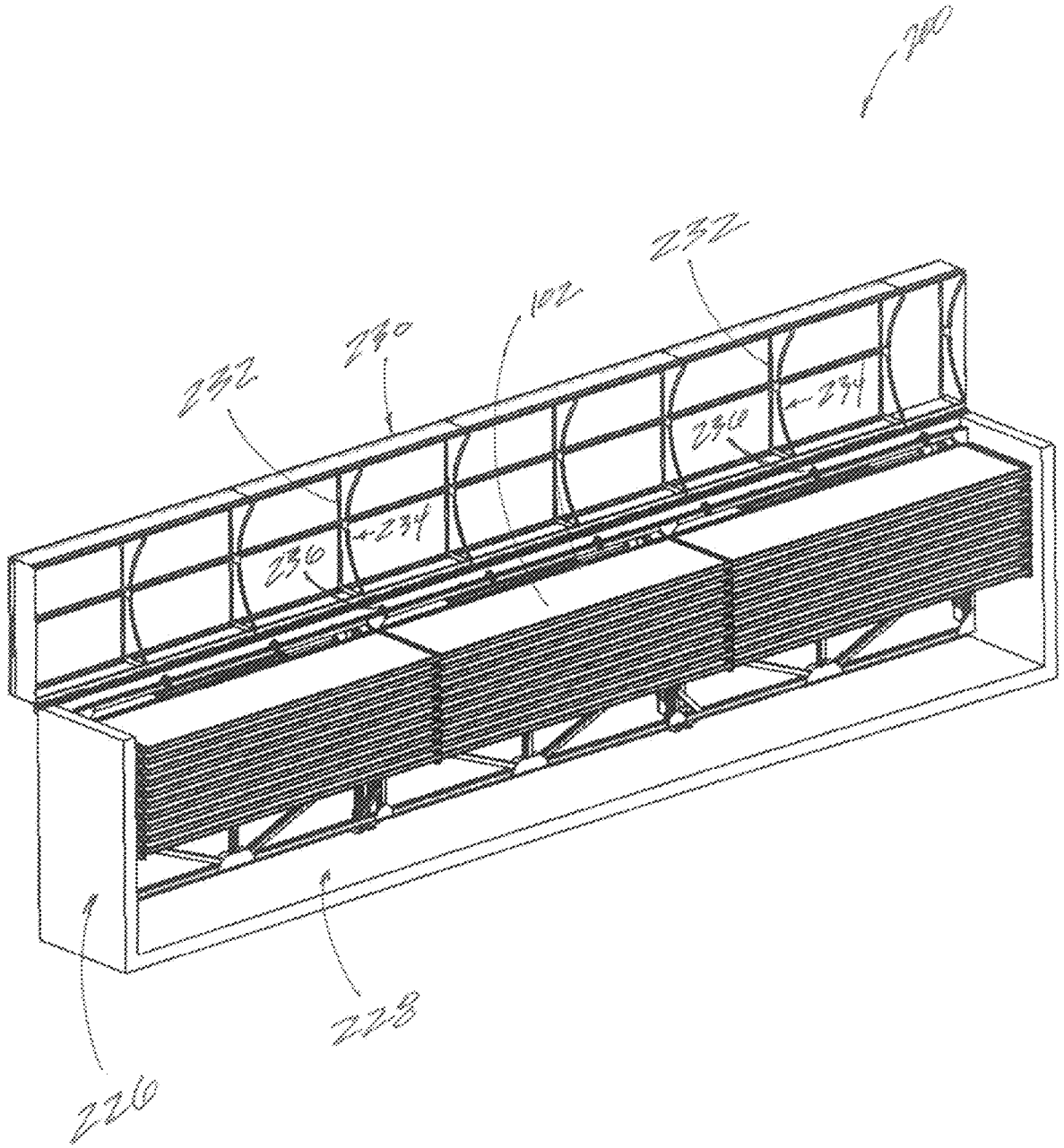

In some embodiments, as shown in FIGS. 19-20, the panel delivery system 200 and the panels 102 that it may hold are contained within a panel vault 226 including a vault inner volume 228 and a vault cover 230. FIG. 19 shows the vault 226 with the cover 230 closed, and FIG. 20 shows the vault 226 with the cover 230 open. One purpose of the vault 226 is to contain, stow, and protect the panel delivery system 200 and the panels 102 when the system 10 is generally not in use.

In some embodiments, the vault cover 230 is hingedly coupled to a side of the vault 226 (e.g., the back side in FIGS. 19-20) and includes one or more underside trusses 232 arranged parallel with one another periodically from the vault's first end to the vault's second end. In some embodiments, each truss 232 includes an underside concave curvature 234 (e.g., an arc) extending between its front end and its rear end that serves as a rolling surface for cover rollers 236 (described below).

Figure 21:
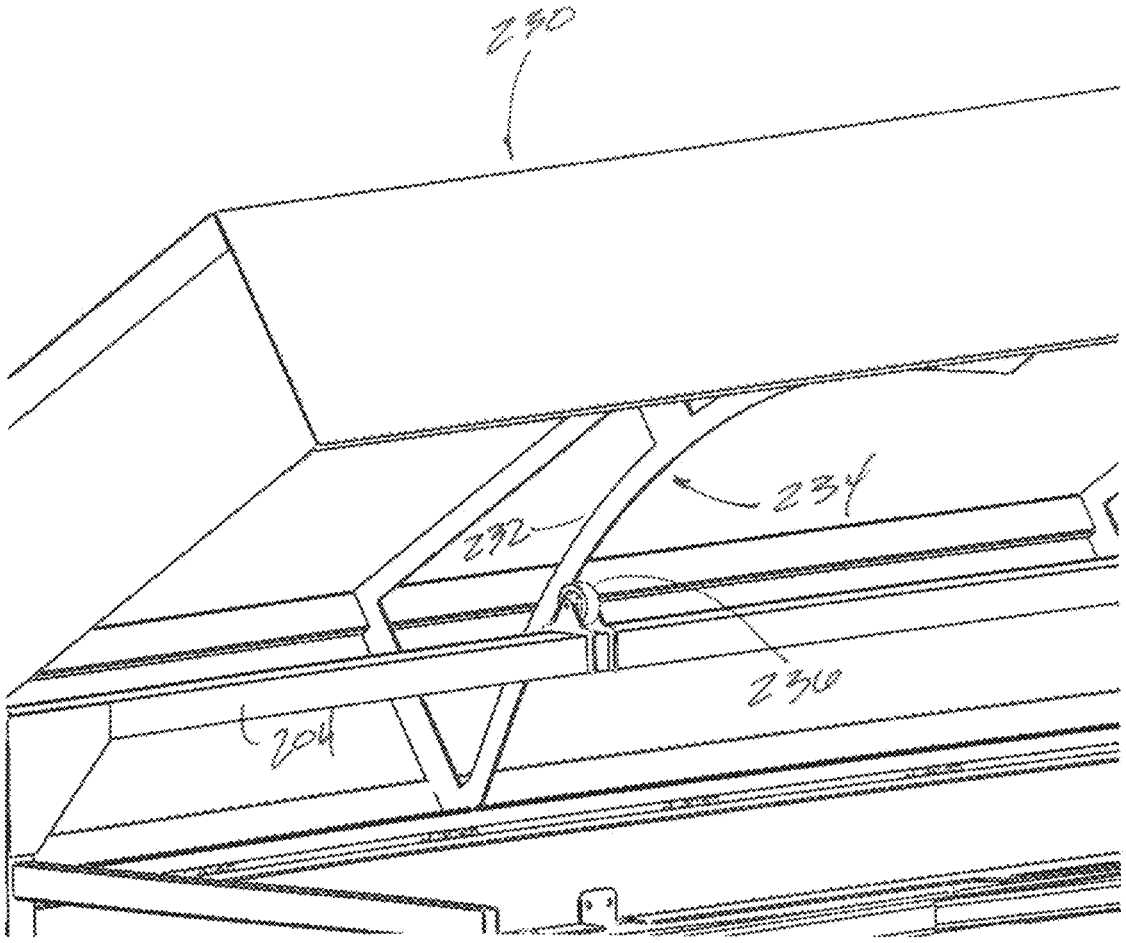
FIG. 21 shows aspects of a panel delivery system according to exemplary embodiments hereof.

In some embodiments, as shown in FIGS. 20-21, an upper lateral support element 205 of the delivery system's frame 202 includes one or more cover rollers 236. Each cover roller 236 is mounted on the lateral support element 205 in alignment with a respective truss 232 such that as the upper support element 205 is raised (as part of the frame 202) by the frame lifter assembly 212, each cover roller 236 engages and rolls upon its respective truss's underside concave curvature 234, thereby pushing the vault cover 230 open as the frame 202 moves upward. The vault cover 230 may be coupled to the vault 226 using hinge including a pre-torqued spring (e.g., a torsion spring) so that, if necessary, the cover 230 may be opened manually.

Figure 22:
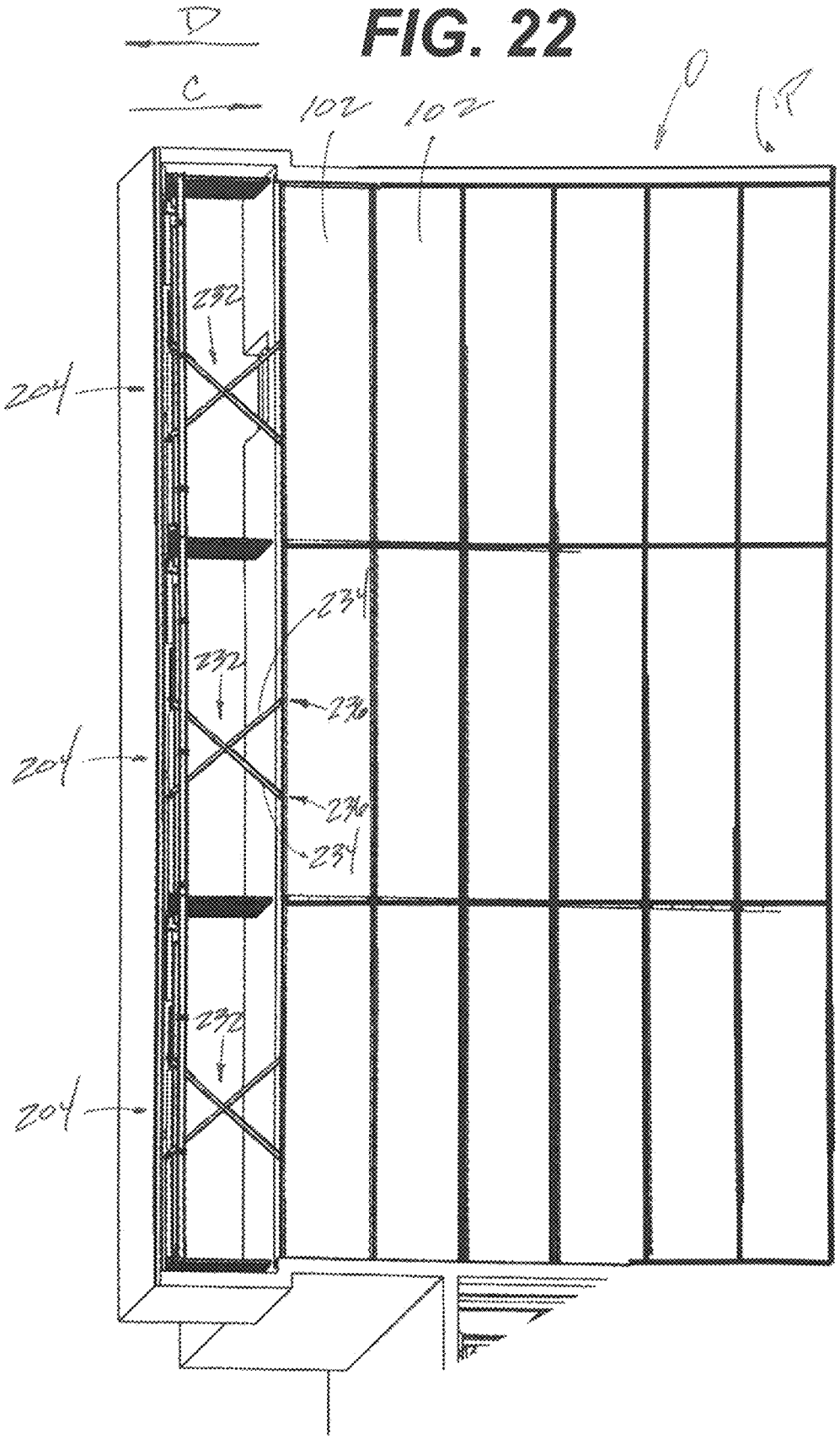
FIGS. 22-23 show aspects of a panel delivery system with panels according to exemplary embodiments hereof.
Figure 23:
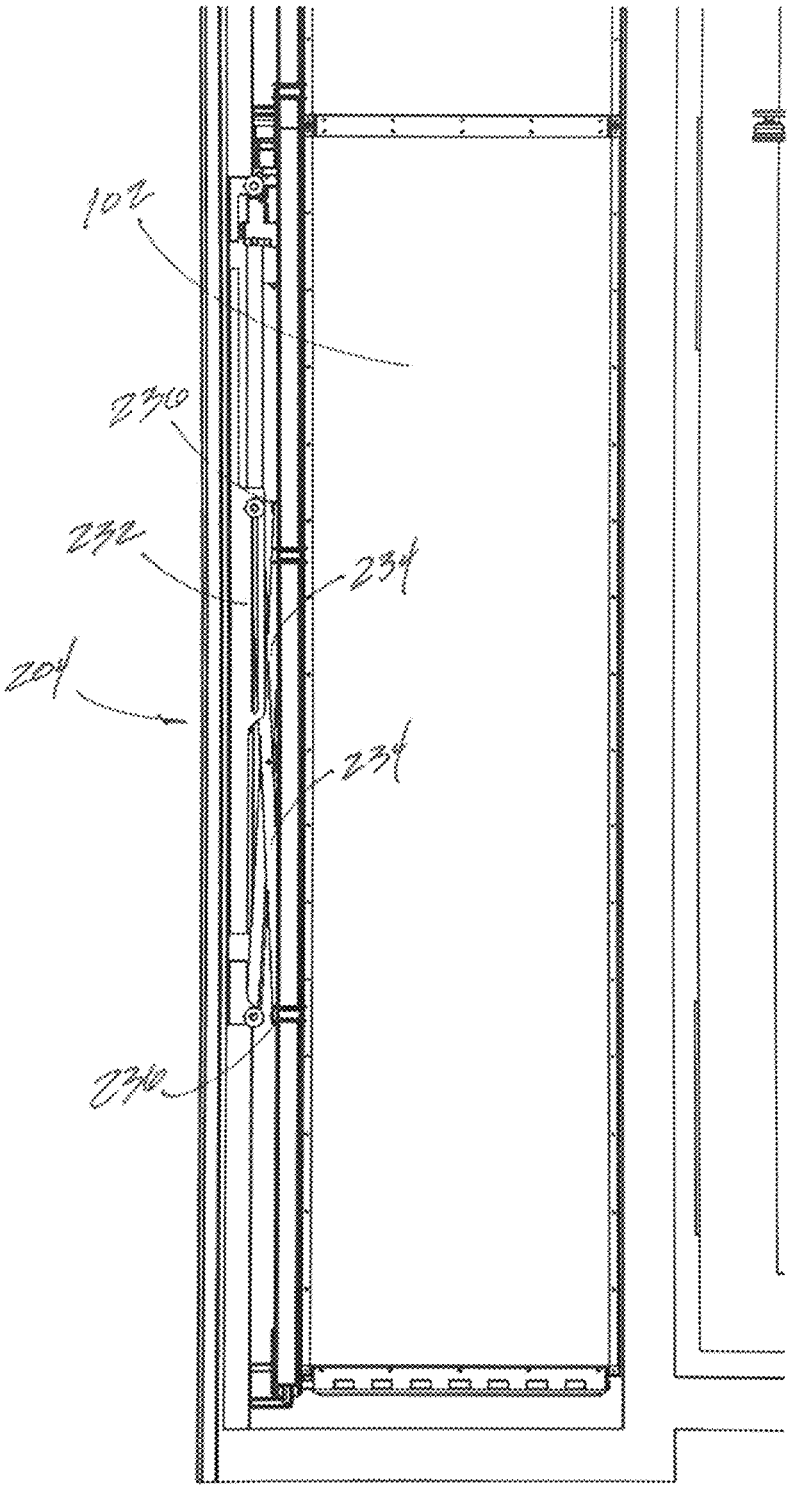

In some embodiments, as shown in FIGS. 22-23, the panel pusher 204 includes a scissor mechanism 232. See FIGS. 3-10 for a generalized version of the pusher 204. FIG. 22 is a top view of the panel delivery system 200 and the panel assembly 100, with the panels 102 delivered to the panel guide system 300 (obstructed from view by the deployed panels 102) and generally deployed across the opening O of the pit P. In addition, the panel pusher 204 is in its fully extended position thereby holding the deployed panels 102 in place as described in other sections. FIG. 23 shows a single panel pusher 204 (a scissor mechanism 232) in its retracted position prior to the pushing of the adjacent panel 102. It is understood that the panel pusher 204 may include other types of displacement mechanisms, such as, without limitation, pistons, pneumatic actuators, hydraulic actuators, movement columns, rack and pinion mechanisms, other types of displacement mechanisms, and any combinations thereof.

In some embodiments, as shown in FIGS. 22-23, each scissor mechanism 232 includes at least two crossed scissor arms 234 arranged to expand (in the direction of the arrow C) and/or to retract (in the direction of the arrow D). In this way, the panel pusher 204 provides the panel pushing and panel pusher retracting functionalities as described in the embodiments of FIGS. 3-10. In some embodiments, the panel pushers 204 are located at positions generally between the bracket arms 208, however, it is understood that the panel pushers 204 may be located in any position as required.

In some embodiments, the distal ends of the scissor arms 234 (the ends that make contact with and push the panels 102) include rollers 236 that may ride upon the edge of the panel 102 at the point of contact thereby pushing the panel 102 in the direction of the arrow C as the scissor mechanisms 232 expand. While a total of three panel pushers 204 are shown in FIG. 22, it is understood that any number of panel pushers 204 may be used.

Figure 24:
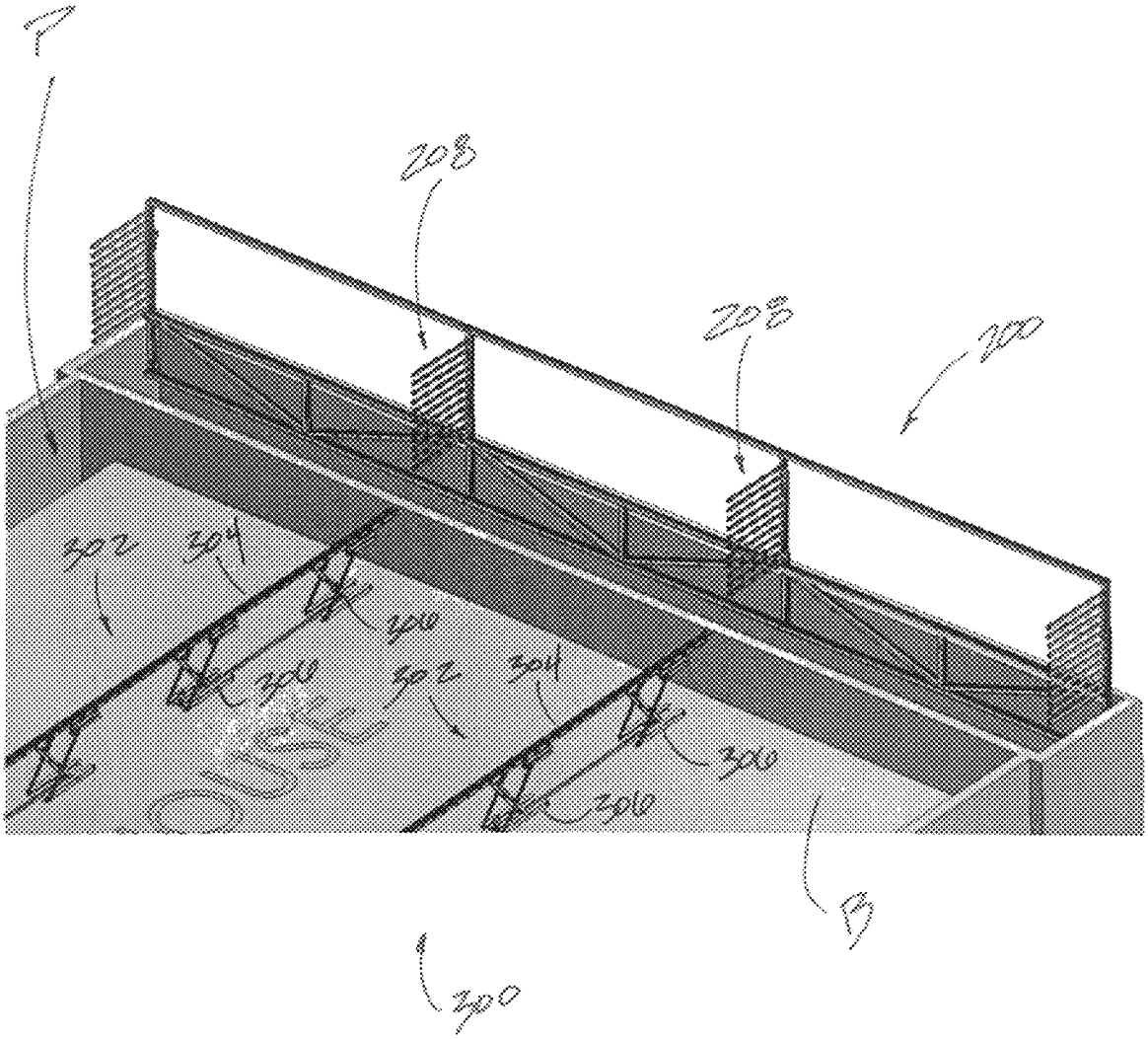
FIG. 24 shows aspects of a panel delivery system and a panel guide system according to exemplary embodiments hereof.

In some embodiments, as shown in FIG. 24, the panel guide system 300 includes one or more guide units 302 comprising one or more guide rails 304 supported by one or more guide base structures 306. In some embodiments, the guide units 302 are configured with an upper portion of the building B, e.g., with the building's roof. As described in other sections with respect to FIGS. 3-10, the guide units 302 are designed to receive the panels 102, one by one, from the panel delivery system 200, and to guide the panels 102 across the open area O of the pit P until all of the panels 102 are deployed and the opening O is adequately covered. The guide units 302 also provide support to the panels 102 to minimize sag over the span of the opening O.

Figure 25:
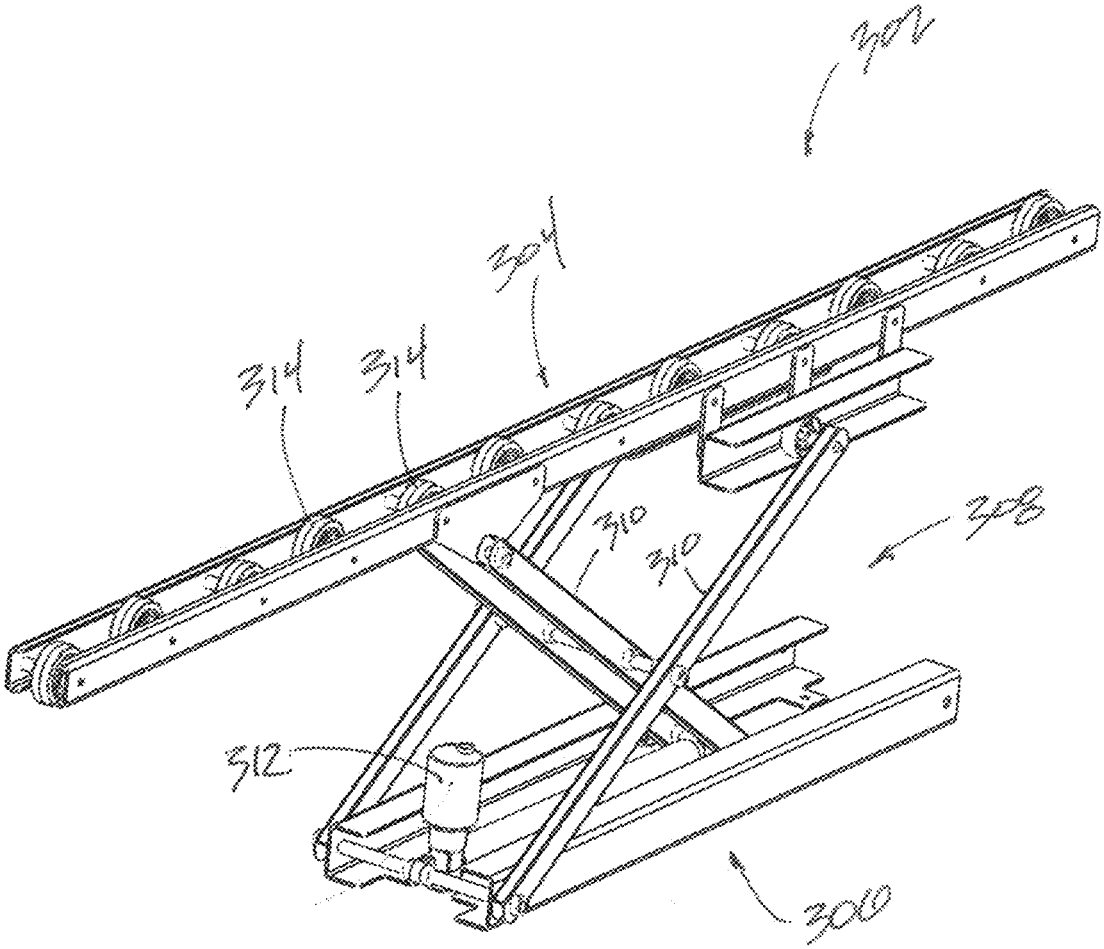
FIG. 25 shows aspects of a panel guide unit according to exemplary embodiments hereof.

In some embodiments, the guide base structures 306 are designed to move the guide rails 304 up and down for deployment and stowage, respectively. That is, the base structures 306 may lower the guide rails 304 into a lower position when the system 10 is not in use and may lift the guide rails 304 upward into an upper position prior to the deployment of the panels 102 when the system 10 is in use (e.g., when the building B is being lowered into the pit P). In order to accomplish this functionality, the guide base structures 306 may include lifting mechanisms such as scissor lifting mechanisms 308 as shown in FIGS. 24-25. It also is understood that other types of lifting systems also may be used, such as, lifting columns, rack and pinion mechanism, other suitable lifting mechanisms, and any combinations thereof.

Each scissor lifting mechanism 308 may include two or more crossed scissor lift arms 310 as shown. In addition, each scissor lift mechanism 308 may include an actuator 312 configured with the lift arms 310 to cause the expansion and/or retraction of the arms 310. In some embodiments, an actuator 312 may be shared between two or more scissor lift mechanisms 308. For example, a first scissor lift mechanism's actuator 312 may be connected to a second scissor lift mechanism's scissor lift arms 310 (e.g., via a steel plate or rod) such that movement of the actuator 312 causes both the first and second scissor lift mechanisms 308 to extend and/or to retract. In this way, the second scissor lift mechanism 308 may be referred to as a dummy lift mechanism.

Referring back to FIGS. 3-10, it can be seen that for the panel delivery system 200 to properly deliver the panels 102 to the panel guide system 300, i.e., onto the guide rails 304, the guide rails 304 are preferably aligned vertically with the respective panel 102 as it is delivered. Accordingly, the guide base structures 306 preferably lift the guide rails 102 vertically to the proper alignment position with respect to the panel delivery system 200 (e.g., with respect to the bracket 208 and panel 102 being deployed) prior to the deployment of the panels 102.

In some embodiments, as shown in FIG. 24, a first guide unit 302 is aligned with a first of the two inner columns of bracket arms 208 of the panel delivery system 200, and a second guide unit 302 is aligned with a second of the two inner columns of bracket arms 208. In addition, in some embodiments, as shown in FIG. 25, the guide rails 304 of the first and second guide units 302 described above may include topside rollers 314 designed to engage the panels 102 as the panels 102 are deployed onto the rails 304. In addition, by being aligned with the first and second inner columns of bracket arms 208, the first and second rail units 302 also are aligned with the couplers 108 on each of the panels 102 as the panels 102 are deployed. In this way, the couplers 108 serve as rigid flat surfaces (e.g., roller plates)

that may smoothly roll upon the rollers 314 during the movement of the panels 102 on the guide rails 304 across the opening O.

Figure 26:
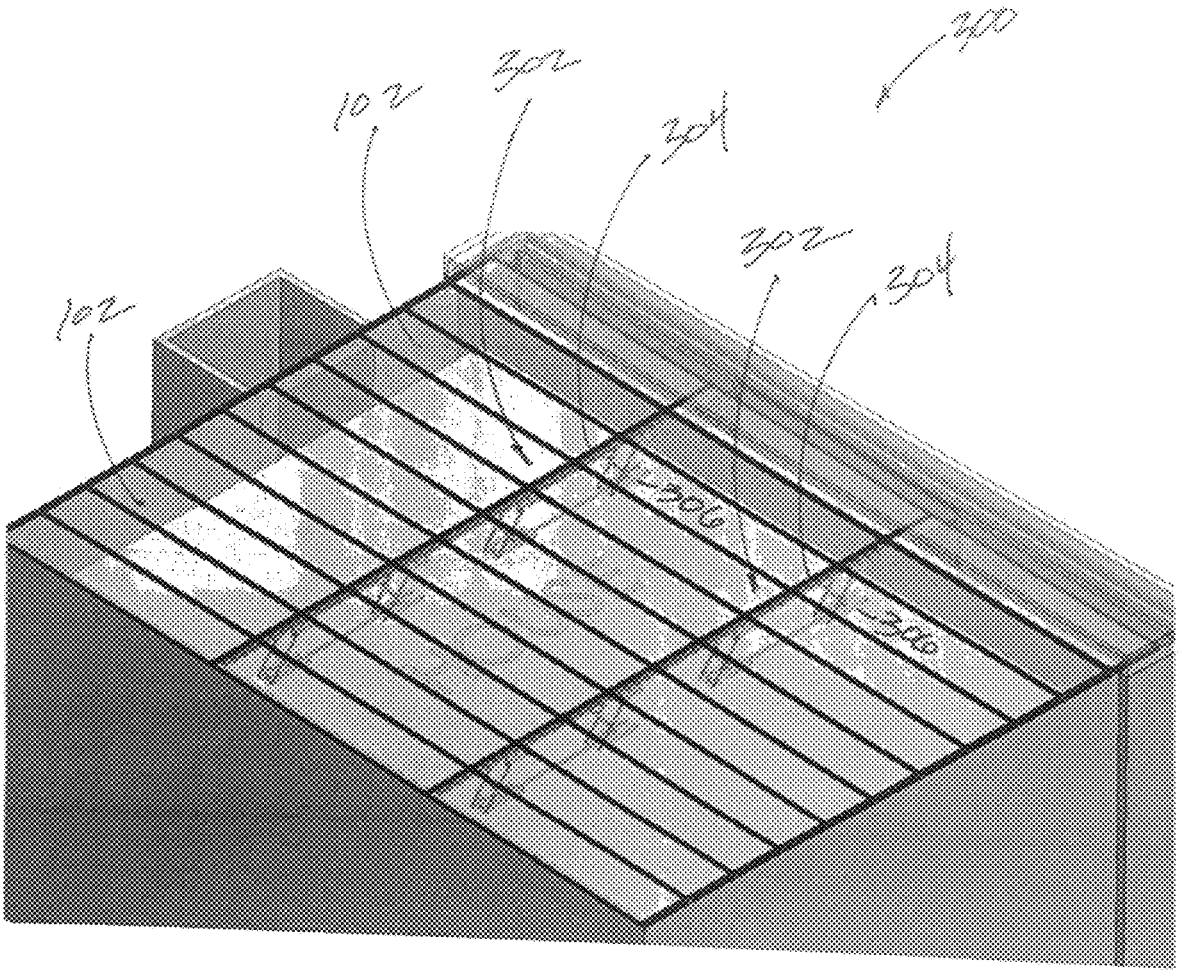
FIG. 26 shows aspects of a panel guide system with panels according to exemplary embodiments hereof.

FIG. 26 shows the panels 102 fully deployed across the opening O while supported by the panel guide system 300, with the panels 102 shown as transparent for clarity.

Figure 27:
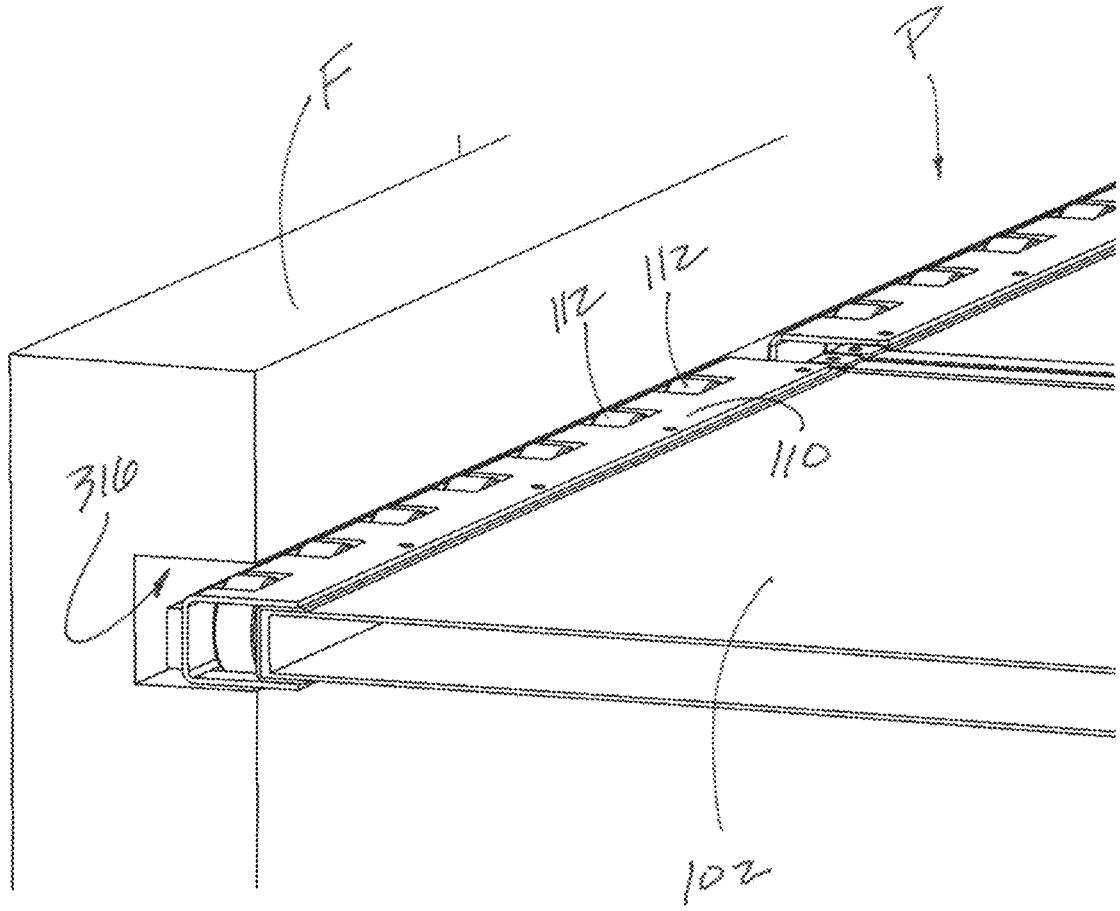
FIG. 27 shows aspects of a panel within a channel according to exemplary embodiments hereof.

In some embodiments, as shown in FIG. 27, the pit P includes a foundation F that generally provides the structure within which the building B may be lowered into. In some embodiments, the foundation F includes side channels 316 designed to receive the end caps 110 of the panels 102 on either side and to provide a surface on which the end cap rollers 112 may roll. Accordingly, it may be preferable that the channels 316 extend along the sides of the foundation F generally parallel to the guide rails 304 so that while the guide rails 304 provide support to the inner regions of the panels 102, the channels 316 provide support to the outer regions of the panels 102 as the panels 102 are deployed. It also is preferable that the channels 316 generally extend from the deployment system 200 to the opposite side of the pit P such that the panels 102 may ride within the channels 316 from one end of the pit P to the other.

In some embodiments, the system 10 is triggered to perform its functionalities when the building B is lowered into the pit P.

It is understood that any aspect and/or element of any embodiment of the system 10 as described herein may be combined with any aspect and/or element of any other embodiment of the system 10 to form additional embodiments of the system 10, all of which are within the scope of the system 10.

Where a process is described herein, those of ordinary skill in the art will appreciate that the process may operate without any user intervention. In another embodiment, the process includes some human intervention (e.g., a step is performed by or with the assistance of a human).

Those of ordinary skill in the art will appreciate and understand, upon reading this description, that embodiments hereof may provide different and/or other advantages, and that not all embodiments or implementations need have all advantages.

Where a process is described herein, those of ordinary skill in the art will appreciate that the process may operate without any user intervention. In another embodiment, the process includes some human intervention (e.g., a step is performed by or with the assistance of a human).

As used herein, including in the claims, the phrase "at least some" means "one or more," and includes the case of only one. Thus, e.g., the phrase "at least some ABCs" means "one or more ABCs", and includes the case of only one ABC.

As used herein, including in the claims, term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

As used herein, including in the claims, the phrase "based on" means "based in part on" or "based, at least in part, on," and is not exclusive. Thus, e.g., the phrase "based on factor X" means "based in part on factor X" or "based, at least in part, on factor X." Unless specifically stated by use of the word "only", the phrase "based on X" does not mean "based only on X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and so on, in the description and claims, are used to distinguish or identify, and not to show a serial or numerical limitation. Similarly, letter labels (e.g., "(A)", "(B)", "(C)", and so on, or "(a)", "(b)", and so on) and/or numbers (e.g., "(i)", "(ii)", and so on) are used to assist in readability and to help distinguish and/or identify, and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

As used herein, including in the claims, the terms "multiple" and "plurality" mean "two or more," and include the case of "two." Thus, e.g., the phrase "multiple ABCs," means "two or more ABCs," and includes "two ABCs." Similarly, e.g., the phrase "multiple PQRs," means "two or more PQRs," and includes "two PQRs."

The present invention also covers the exact terms, features, values and ranges, etc. in case these terms, features, values and ranges etc. are used in conjunction with terms such as about, around, generally, substantially, essentially, at least etc. (i.e., "about 3" or "approximately 3" shall also cover exactly 3 or "substantially constant" shall also cover exactly constant).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components unless specifically so stated.

It will be appreciated that variations to the embodiments of the invention can be made while still falling within the scope of the invention. Alternative features serving the same, equivalent or similar purpose can replace features disclosed in the specification, unless stated otherwise. Thus, unless stated otherwise, each feature disclosed represents one example of a generic series of equivalent or similar features.

The present invention also covers the exact terms, features, values and ranges, etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

Use of exemplary language, such as "for instance", "such as", "for example" ("e.g.,") and the like, is merely intended to better illustrate the invention and does not indicate a limitation on the scope of the invention unless specifically so claimed.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

The invention claimed is:

1. An extendable cover system for extending a cover over an opening, the system comprising:

a panel holding assembly configured at a first side of the opening, the panel holding assembly including at least one panel holding arm;

one or more panels oriented horizontally and configured with the at least one panel holding arm;

at least one guide rail adjacent the at least one panel holding arm, the at least one guide rail including a base structure adapted to move the at least one guide rail along a vertical axis; and a panel moving mechanism configured to move the one or more panels from the at least one panel holding arm onto the at least one guide rail.

2. The extendable cover system of claim 1 wherein a first at least one panel holding arm holding a first one or more panels is aligned vertically with the at least one guide rail at a deployment position.

3. The extendable cover system of claim 2 further comprising:

a motor configured with the panel holding assembly and adapted to move the first at least one panel holding arm along a vertical axis to the deployment position.

4. The extendable cover system of claim 3 wherein when the first at least one panel holding arm is at the deployment position, the panel moving mechanism moves the first one or more panels from the first at least one panel holding arm onto the at least one guide rail.

5. The extendable cover system of claim 4 wherein the panel moving mechanism is configured to move the first one or more panels along a horizontal axis from the first at least one panel holding arm onto the at least one guide rail.

6. The extendable cover system of claim 4 further comprising a second at least one panel holding arm holding a second one or more panels below the first one or more panels, wherein when the first one or more panels has been moved onto the at least one guide rail, the motor moves the second at least one panel holding arm to the deployment position and the panel moving mechanism moves the second one or more panels from the second at least one panel holding arm onto the at least one guide rail.

7. The extendable cover system of claim 1 wherein the at least one guide rail extends orthogonally away from the one or more panels.

8. The extendable cover system of claim 1 wherein the opening includes an opening width, and the one or more panels includes a panel length that is greater than or equal to the opening width.

9. The extendable cover system of claim 1 wherein the opening includes an opening length, and an aggregate width of the total number of the one or more panels is greater than or equal to the opening length.

10. The extendable cover system of claim 1 wherein the at least one panel arm includes a panel arm topside, and the panel arm topside includes rollers adapted to engage the one or more panels.

11. The extendable cover system of claim 1 wherein the at least one guide rail includes a guide rail topside, and the guide rail topside includes rollers adapted to engage the one or more panels.

12. The extendable cover system of claim 1 wherein the opening is defined at least in part by a foundation, and wherein the one or more panels include rollers adapted to roll upon a surface of the foundation.

13. The extendable cover system of claim 1 wherein the panel moving mechanism includes at least one of a scissor mechanism, a piston, a pneumatic actuator, a hydraulic actuator, movement column, and a rack and pinion mechanism.

14. A method of extending a cover over an opening, the method comprising:

(A) providing a first panel holding arm holding a first panel at a side of the opening, the first panel oriented horizontally;

(B) providing a guide rail adjacent to the first panel holding arm;

(C) aligning the first panel holding arm vertically with the guide rail at a deployment position;

(D) using a panel moving mechanism to move the first panel from the first panel holding arm onto the guide rail;

(E) providing a second panel holding arm holding a second panel at the side of the opening, the second panel oriented horizontally;

(F) aligning the second panel holding arm vertically with the guide rail at the deployment position; and (G) using the panel moving mechanism to move the second panel from the second panel holding arm onto the guide rail.

15. The method of claim 14 wherein the aligning the first panel holding arm vertically with the guide rail at the deployment position includes using a motor to move the first panel holding arm.

16. The method of claim 14 wherein the panel moving mechanism moves the first panel from the first panel holding arm onto the guide rail along a horizontal axis.

17. The method of claim 14 wherein the guide rail extends orthogonally away from the first panel.

18. An extendable cover system for extending a cover over an opening, the system comprising:

a panel holding assembly configured at a first side of the opening, the panel holding assembly including at least one panel holding arm;

one or more panels configured with the at least one panel holding arm;

a first at least one panel holding arm holding a first one or more panels and a second at least one panel holding arm holding a second one or more panels below the first one or more panels;

at least one guide rail adjacent the first at least one panel holding arm wherein the first at least one panel holding arm is aligned vertically with the at least one guide rail at a deployment position;

a panel moving mechanism configured to move at least one of the one or more panels from at least one of the at least one panel holding arms onto the at least one guide rail when the at least one of the at least one panel holding arms is at the deployment position;

a holding arm moving mechanism configured with the panel holding assembly and adapted to move the at least one of the at least one panel holding arms along a vertical axis to the deployment position;

wherein when the first one or more panels has been moved onto the at least one guide rail by the panel moving mechanism, the motor moves the second at least one panel holding arm to the deployment position and the panel moving mechanism moves the second at least one or more panels from the second at least one panel holding arm onto the at least one guide rail.

19. A method of extending a cover over an opening, the method comprising:

(A) providing a first panel holding arm holding a first panel at a side of the opening, the first panel oriented horizontally;

(B) providing a guide rail adjacent to the first panel holding arm;

(C) moving the guide rail vertically to a deployment position;

(D) aligning the first panel holding arm vertically with the guide rail at the deployment position; and (E) using a panel moving mechanism to move the first panel from the first panel holding arm onto the guide rail.

20. An extendable cover system for extending a cover over an opening, the system comprising:

a panel holding assembly configured at a first side of the opening, the panel holding assembly including at least one panel holding arm;

one or more panels oriented horizontally and configured with the at least one panel holding arm;

at least one guide rail adjacent the at least one panel holding arm; and a panel moving mechanism located on a side of the at least one panel holding arm opposite the opening and configured to push the one or more panels from the at least one panel holding arm onto the at least one guide rail.

* * * * *